US009157209B2

(12) United States Patent
Biserna et al.

(10) Patent No.: US 9,157,209 B2
(45) Date of Patent: Oct. 13, 2015

(54) HELICAL DRILL BIT FOR AN AUGER OF A GROUND EXCAVATION ASSEMBLY, IN PARTICULAR FOR BUILDING EXCAVATED PILES, AND DRILLING METHOD THAT USES SUCH A BIT

(71) Applicant: SOILMEC S.p.A., Cesena (FC) (IT)

(72) Inventors: Ezio Biserna, Cesena (IT); Daniele Vanni, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 127 days.

(21) Appl. No.: 13/875,577

(22) Filed: May 2, 2013

(65) Prior Publication Data

US 2013/0294843 A1 Nov. 7, 2013

(30) Foreign Application Priority Data

May 7, 2012 (IT) ..... TO2012A0405

(51) Int. Cl.

| | |
|---|---|
| ***E21B 10/44*** | (2006.01) |
| ***E02D 7/30*** | (2006.01) |
| ***E21B 17/12*** | (2006.01) |
| ***E21B 7/00*** | (2006.01) |
| ***E21B 10/26*** | (2006.01) |

(52) U.S. Cl.

CPC . *E02D 7/30* (2013.01); *E21B 7/005* (2013.01); *E21B 10/26* (2013.01); *E21B 10/44* (2013.01); *E21B 17/12* (2013.01)

(58) Field of Classification Search

USPC ..... 405/231, 232, 249, 252.1, 253; 175/394, 388, 323

See application file for complete search history.

(56) References Cited

U.S. PATENT DOCUMENTS

| | | | | |
|---|---|---|---|---|
| 4,771,830 | A * | 9/1988 | Peate | 166/241.6 |
| 5,366,031 | A | 11/1994 | Rickards | |
| 7,357,200 | B2 * | 4/2008 | Harleman | 175/323 |
| 2004/0188149 | A1 * | 9/2004 | Thigpen et al. | 175/398 |
| 2007/0251730 | A1 | 11/2007 | Barbera et al. | |
| 2009/0223721 | A1 * | 9/2009 | Dourfaye | 175/426 |
| 2009/0317194 | A1 * | 12/2009 | Stoetzer et al. | 405/233 |
| 2011/0305527 | A1 * | 12/2011 | Curic et al. | 405/271 |
| 2012/0090896 | A1 * | 4/2012 | Niekamp | 175/57 |
| 2012/0273275 | A1 * | 11/2012 | Broussard, Jr. | 175/57 |

FOREIGN PATENT DOCUMENTS

| | | | | |
|---|---|---|---|---|
| EP | 404703 | A1 * | 12/1990 | |
| EP | 0 974 729 | A1 | 1/2000 | |
| GB | 2 133 821 | A | 8/1984 | |
| JP | 06-081572 | | 3/1994 | |
| JP | 06081572 | A * | 3/1994 | |
| JP | 07071033 | A * | 3/1995 | E02D 5/44 |
| WO | WO 2010/030784 | A1 | 3/2010 | |

* cited by examiner

*Primary Examiner* — Benjamin Fiorello
*Assistant Examiner* — Kyle Armstrong
(74) *Attorney, Agent, or Firm* — Lucas & Mercanti, LLP

(57) ABSTRACT

The helical drill bit defines a helical end section of a helical structure formed at its periphery by an auger of an excavation assembly, and it is associated or associable with a support portion of the auger. Such a support portion defines a proximal section of the helical structure, which has an extension substantially centered around a longitudinal axis (X-X). The helical drill bit is adapted to rotate about the longitudinal axis (X-X) together with the support portion so as to drill a hole in the ground. The helical end section extends around an extremity axis (Y-Y; Ψ-Ψ) that is not aligned relative to the longitudinal axis (X-X).

15 Claims, 15 Drawing Sheets

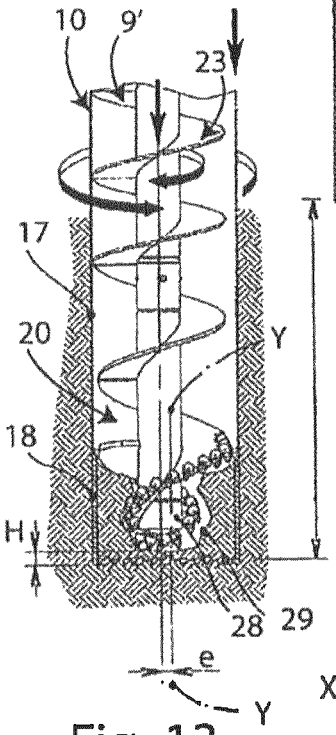
Fig. 13
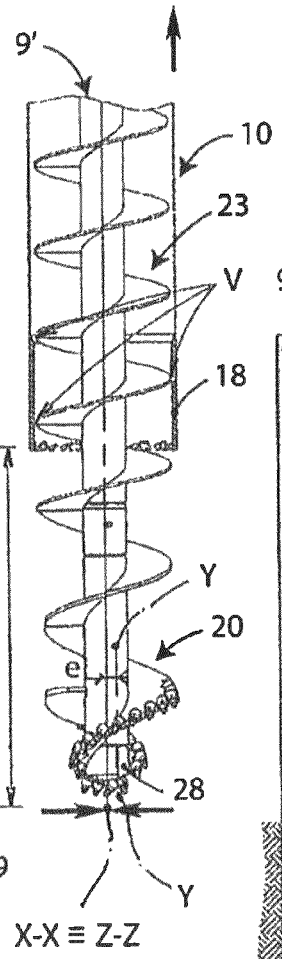
Fig. 14
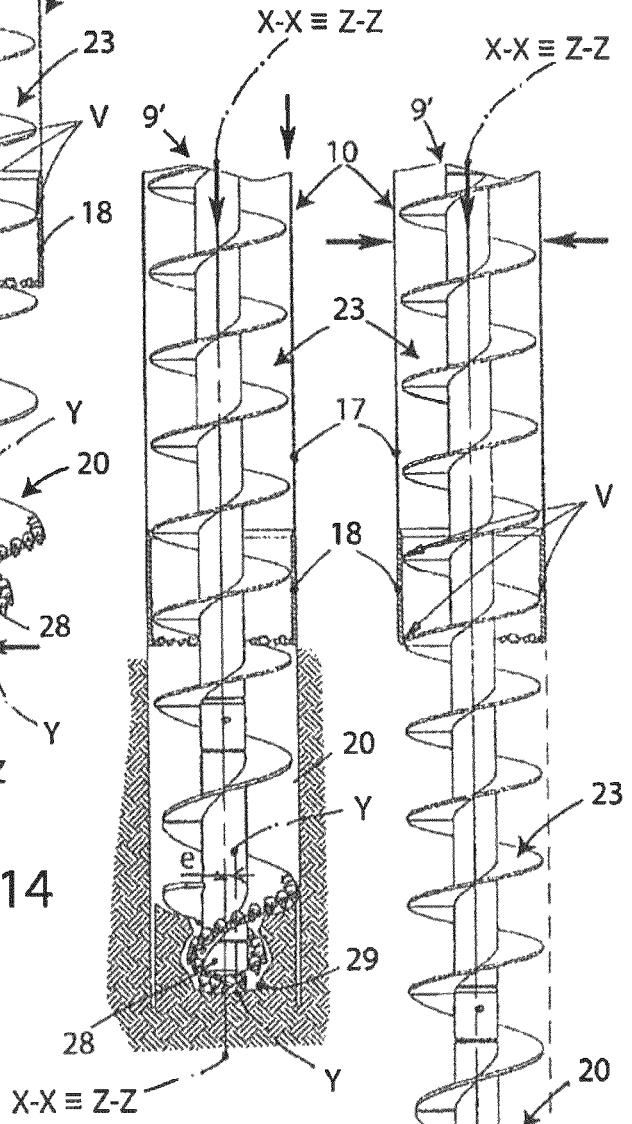
Fig. 15
Fig. 16

HELICAL DRILL BIT FOR AN AUGER OF A GROUND EXCAVATION ASSEMBLY, IN PARTICULAR FOR BUILDING EXCAVATED PILES, AND DRILLING METHOD THAT USES SUCH A BIT

CROSS REFERENCE TO RELATED APPLICATION

This patent application claims the benefit of Italian Patent Application. No. TO2012A 000405, filed May 7, 2012, the entire contents of which are incorporated herein by reference.

DESCRIPTION

1. Technical Field

The present invention concerns a helical drill bit for an auger of a ground excavation assembly, in particular for building excavated piles, and a drilling method that uses such a bit.

More specifically, the present invention refers to a helical drill bit made according to the preamble of the attached claim 1, and to a drilling method carried out with the aforementioned helical drill bit.

2. Technological Background

The present invention thus fits into the technological field of foundations in which, for almost twenty years, the technique of the so-called pile excavated with a continuous auger, partially or totally piped, has been known. In particular, for building excavated piles equipment is generally used that is adapted to carry out drilling or excavations having a substantially cylindrical shape with a vertical longitudinal axis, or having the desired inclination, relative to the surface of the ground (so-called "land surface") on which the piles are intended to be made. In such a rolling or excavations concrete is then cast that, by setting, forms the excavated piles that constitute the foundation structure for the subsequent work on top.

In particular, when it is wished to make a barrier or a partition formed from intersecting piles (partially penetrating one another) it is essential to guide these holes or excavations so that all of the piles are as "vertical" as possible, i.e. they are oriented in the desired direction relative to the land surface. Typically, making a partition formed from intersecting piles (identified and ordered for the sake or simplicity according to progressive numbering, i.e. with 1, 2, 3, . . . ) requires that primary piles (identified with odd numbers of the previous numbering, i.e. with 1, 3, 5, . . . ) be made through drilling for a certain section. When the curing of primary piles occurs, generally a few days after they have been made, the secondary piles (in turn identified with even numbers of the previous numbering, i.e. with 2, 4, 6, . . . ) are made by drilling adjacent, to the right and left respectively, to the primary piles (pile 2 adjacent to and interpenetrating with the primary piles 1 and 3, and so on), thus forming a substantially continuous partition or barrier. The correct penetration and the correct orientation, vertical or inclined, of all of these piles therefore work together to suitably make the excavated partition that, when filled with concrete according to what is known in the field, ensures an adequate support and impermeabilisation (when required) in the case of underground works or out-of-ground works.

With reference to FIG. 1 an example of per se known drilling equipment is wholly represented, which is particularly intended for making piped piles.

As shown in FIG. 1, the equipment comprises a self-propelled machine 1 and a mast 2 supported and arranged in a direction that is substantially ascending and vertical with respect to the machine 1. Clearly, the machine 1 has a carrying capacity suitable for supporting the mast 2 also during movement and it preferably comprises a cabin supported by a tracked structure (details not numbered) that allows it to move on the land surface. The mast 2 can advantageously move with respect to the machine 1, for example by means of a fluid actuator system, in particular one or more hydraulic cylinders (details not numbered), mounted between such a mast 2 and such a machine 1. In a preferred manner, the equipment can comprise an alignment system (details not numbered), for example an articulated parallelogram structure, suitable for keeping the mast 2 in the desired ascending direction with respect to the machine 1.

The equipment illustrated in FIG. 1 also comprises a trolley 3 that is mobile along the mast 2, a lower drive head 4*i* and an upper drive bead 4*s* both carried by the same trolley 3. In a per se known way, the drive heads 4*i*, 4*s* are able to transform the power, typically of the hydraulic type, supplied by the machine 1 into the mechanical power (more specifically rotary and/or pushing and/or pulling) necessary to carry out the drilling or excavation by the actual excavation assembly of the equipment, which will be described hereafter. In the example represented, the drive heads are rotary tables 4*i*, 4*s* of the per sé known type (generally known by the name "rotary") suitable for setting in rotation and imparting the pulling and pushing movements on the aforementioned excavation assembly of the equipment.

The equipment illustrated also comprises a guide member 5, for example of the hydraulic or manual type, which is mounted near to the base of the tower 2 and that is suitable for ensuring, in a per sé known way, that the appropriate orientation, vertical or inclined, of the excavation assembly is maintained. Preferably, the guide member comprises an openable annular element 5 adapted to wrap around the excavation assembly so as to keep them in the appropriate orientation or "verticality" in the first meters of the drilling or excavation. Clearly, such an annular element 5 can be opened at the suitable moment by the operator in the subsequent steps of the drilling operations.

According to FIG. 1, the equipment also comprises a sliding device 6 adapted to space from each other the drive heads 4*i*, 4*s* that are supported by the same trolley 3. Advantageously, the sliding device is a jack 6, connected, on one side, with the lower drive head 4*i* and, on the other side, with the upper drive head 4*s*, so as to take them away from or towards each other. For example, the relative travel between the drive heads 4*i*, 4*s* is of the order of magnitude of a few tens of centimeters.

Furthermore, the equipment comprises an axial movement system adapted to lift the load deriving from the assembly formed from the trolley 3, the drive heads 4*i*, 4*s* and the relative excavation assembly associated with them. As illustrated in FIG. 1, the axial movement system of the drive heads comprises at least one hoisting winch 7 acting on the trolley 3 so as to move the latter through an appropriate traction winch including for example one or more cables and/or one or more ropes or other flexible traction elements that can be used for this purpose (for example chains, etc.). Optionally, the axial movement system of the drive heads can also include a second traction rope, relayed towards the lower snub pulley 8 to exert a push on the trolley 3. Such systems are known and are applicable to different specific set-ups for different technologies: kelly, continuous auger, piped continuous auger, soil mixing, Turbojet, jet grouting, bucket, CTjet, etc. In a variant, the hoisting winch 7 can stay connected to a departing rope and a further winch (not shown) can be added to exert the push on the trolley 3. In the illustrated example, the hoisting winch 7 and/or the relay winch for pushing (and the snub pulley 8) are supported by the mast 2. Therefore, the lifting system fulfils the function of lifting, through traction, the aforementioned assembly and also performs the task of exerting a push, on the aforementioned assembly so as to suitably drive the excavation assembly in the ground to allow it to be drilled.

In the example shown in FIG. 1, the equipment also includes an excavation assembly comprising an auger or drilling tool 9 typically shaped like an Archimedean screw or auger, henceforth called "auger" for the sake of simplicity. Such an auger 9 is supported and can be set in rotation by the upper drive head 4*s*. The aforementioned excavation assembly also comprises a substantially cylindrical casing pipe (also known as "guide pipe" and often defined as "casing") 10, coaxial with the auger 9, supported and able to be set in rotation by the lower drive head 4*i* and connected to it for the necessary pulling and pushing movements.

When the equipment described above is operating, the upper drive head 4*s* and the lower drive head 4*i* are thus adapted to control, independently from one another, the rotation of the auger 9 and of one casing pipe 10 about the respective longitudinal axes. In general, in order to avoid joints and blockages of ground rising on the drilling tool 9 that is typically shaped, like an auger, the casing pipe 10 and the auger 9 are placed in counter-rotation to one another (in other words one of the two rotates about its longitudinal axis in a predetermined direction of rotation, whereas the other rotates simultaneously in the opposite direction of rotation). In a preferred manner, to the person observing the equipment from above, the rotation imparted on the auger 9 is directed in the clockwise direction, whereas the rotation imparted on the casing pipe is directed in the anti-clockwise direction.

Again when the equipment illustrated in FIG. 1 is operating, through the winch for hoisting 7, and for pushing through the lower snub pulley 8, the trolley 3, on the other hand, is adapted to actuate the simultaneous sliding of the drilling tool 9 and of the casing pipe 10 along the mast 2. The presence of the single trolley 3 forces the auger 9 and the casing pipe 10 to carry out the drilling progressively and with a construct distance between the bit of the auger 9 and the cutting crown 18 installed beneath the casing pipe 10, apart from their possible relative displacement that can be controlled through the sliding device 6.

In a known variant embodiment of the system represented in FIG. 1, there is just one drive head or rotary (for example 4*s*) and beneath it a mechanical speed gear is installed that allows the motion in input from the drive head or upper rotary 4*s* to be taken and returns two mutually counter-rotating actuations, in which, on the first central actuation the auger 9 is installed and on the outer actuation the casing pipe 10 is installed. In this case, the relative sliding with linear actuator 6 is imparted between the drive head or rotary 4*s* and the inner tube integral with the auger 9 that can thus slide axially relative to the casing pipe 10, by amounts and travels even more substantial than the previous case.

The type of equipment shown in FIG. 1 or its variants are relatively simple and are able to make an excavation in which the depth of the drilling obtained through the penetration in the ground by the auger 9 and the casing pipe 10 (henceforth defined as "piped depth") substantially corresponds to the depth of the hole obtained through the penetration in the ground by just the auger 9 (henceforth defined as "unpiped depth"). This results in an excavated pile having a substantially constant diameter (equal to the excavation diameter of the crown 18) and a longitudinal axis having a suitable orientation, vertical or inclined, along the entire extension of the drilling.

However, the fact that such equipment has a single trolley 3 has the drawback that it is net possible to leave the casing pipe 10 in the excavated hole without disconnecting it from the lower drive head 4*i*. This operation requires costly time and procedures.

In order to avoid the aforementioned drawback, in the field it is known to use a further example of drilling equipment as illustrated in FIG. 2.

With reference to the example of equipment illustrated in FIG. 2, the details that are analogous or similar to those displayed by the example of equipment shown in FIG. 1 have the same alphanumeric references and, for the sake of brevity, will not be described any further hereafter.

Unlike the example represented in FIG. 1, the equipment illustrated in FIG. 2 includes a lower trolley 11*i* and an upper trolley 11*s* slidably mounted on the mast 2, and on which a lower or "intubating" drive head 12*i*, associated with the casing pipe 10 and an upper drive head 12*s* associated with the auger 9 are respectively mounted and supported. The trolleys 11*i*, 11*s* are thus operatively independent from each other and therefore each of them is able to exert an independent push, or pull or the respective drive head 12*i*, 12*s* supported by it. Advantageously, both of the trolleys 11*i*, 11*s* slide along the same guides carried longitudinally by the mast 2 but spaced one from the other in an adjustable manner, manually or automatically (through a data processing unit, known commercially in the field as DMS—Drilling Mate System).

In the example shown in FIG. 2, the lifting system also comprises a pair of lifting devices 7, 14 capable of independently one from the other lifting and lowering (and/or pushing) the lower trolley 11*i* and the upper trolley 11*s*, respectively, thus adjusting the distance thereof. It is also provided for there to be a further service winch 13. In a preferred way, the axial movement devices of the drive heads are winches 7, 14 possibly of the double-cable type (like the winch 7 shown in FIG. 2) mounted either on the rotary rover of the drilling machine 1 or directly on the mast 2 (as indicated in the figures).

The "intubating" drive head 12*i* has an axial opening or inner passage, having an inner diameter such as to allow an auger element 9 to pass through it. Through tins solution it is possible to leave the casing pipe 10 fixed in the ground still connected to the lower drive head 12*i* and advance the drilling tool 9 further, possibly with its entire longitudinal extension, with respect to the casing pipe 10, for example in order to inspect the subsequent depth of the drilling or to extract it to clean the drilling tool 9 itself.

The upper drive head 12*s*, on the other hand, has an inner passage having an inner diameter that is compatible to allow the passage of an extension 15, known in the field as "tube" or "long tube". Such an extension element 15 mounted at the top of the auger 9 has an elongated substantially cylindrical shape, with outer diameter comparable to that of the trunk of the auger 9 (but not necessarily equal), and mechanical locking points that, when mechanically engaged by the drilling drive head 12*s*, allow the correct transmission of the drilling forces (torque, traction, thrust).

In particular, said mechanical locking points can be longitudinal strips for the transmission by friction of the drilling forces or mixed systems with axial abutments for pulling and pushing and longitudinal strips for torque, developed at least locally near to the two extreme areas, lower and upper, which allow a mechanical abutment for the transmission of the forces between tube and upper drive head.

In this way, with respect to the example of equipment illustrated in FIG. 1 and for the same height of the mast 2, the unpiped depth of the drilling can also extend significantly, for example for many meters, beneath the end part or excavation crown 18 of the casing pipe 10 (in other words beyond the so-called piped, depth, the extension of which, on the other hand, remains substantially unchanged). Therefore, the excavated pile that is made with the help of the equipment illustrated in FIG. 2 has a greater length than the equipment, illustrated in FIG. 1. Moreover, the overall structure of such equipment is in any case simpler and more effective than the variant described in FIG. 1, having sliding devices 6 acting directly between tube and upper drive head (to limit the heights of such sliding devices that could otherwise be problematic in the case of restricted spaces or for transportation, it would be necessary to carry out many shorter travels and a multiplicity of grippings that would reduce its effectiveness and would complicate its control).

However, the drilling obtained by using the equipment illustrated above, in particular also using that relative to FIG. 2, has two different diameters. The greater diameter corresponds to the outer diameter exhibited by the casing pipe 10, or more specifically to the cutting diameter of the crown 18 and it extends along the drilling in the piped section of depth, whereas the smaller diameter corresponds to the outer diameter exhibited by the bit of the auger defined by just the drilling tool 9 and it extends along the drilling in the unpiped section of depth. Generally the difference between the greater diameter and the smaller diameter is of an order of magnitude of between about 50 mm and 120 mm (depending on the diameters) and the different shape of the drilling excavated with just the auger should be suitably considered at the design stage considering the actual load-bearing characteristics that the excavated pile obtained through the drilling itself must have.

In order to further clarify how the difference in diameters between the piped depth stud the unpiped depth of the drilling and therefore, in turn, of the excavated pile is generated, hereafter we will describe in detail the structure of the casing pipe 10 used in the example of equipment shown in FIG. 2.

With reference in particular to FIGS. 3 and 4, the casing pipe 10 has a tubular shape that extends around a longitudinal axis Z-Z and defines an internal axial cavity such as to allow the auger 9 to pass through it. In the illustrated example, the casing pipe 10 substantially comprises three sections or portions, in other words a coupling portion or half-joint 16, a jacket pipe 17, a cutting crown or shoe 18 located at the lower end of the casing pipe 10. The coupling portion or halt-joint 16, the jacket pipe 17 and the cutting crown 18 are firmly connected together and act as a monolithic and integral element when the drilling equipment is operating; preferably, they are made from metallic material and, for example, they can be connected together through welding. More specifically, the cutting crown 18 can be removably constrained with respect to the jacket pipe 17, through known fixing devices (screw, cable, key, . . . ).

The coupling portion or half-joint 16 is substantially hollow cylinder shaped, for example with a circular cross section, extending around the axis Z-Z. The half-joint it suitable for allowing the mechanical connection of the upper part of the casing pipe 10 with the "intubating" drive head **12*i* (or with intermediate jacket pipe elements, when the casing pipe consists of more than one jacket pipe, thus when there are at least two half-joints 16). In particular, the connection between the coupling portion or half-joint 16 with the "intubating" drive head 12*i* is provided so as to allow the optimal transmission of mechanical power to the casing pipe 10** to carry out the drilling (for example, by imparting a suitable torque and the pushing force).

Moreover, the coupling portion or half-joint 16 can also be adapted for removable connection with lower or bottom portions of possible further tubular elements that can be interposed between the "intubating" drive head **12*i* and the excavation crown 18** (details not shown).

Preferably, but not necessarily, the coupling portion or half-joint 16 is equipped with connection means of the male type for the connection with the "intubating" drive head **12*i*. The mechanical connection between the coupling portion or half-joint 16 and the "intubating" drive head 12*i*** can take place through one or more fixing systems that are per sé known in the field, for example keys, screws, bayonets and the like.

The jacket pipe 17 has a substantially hollow cylindrical shape, for example with a circular cross section, extending around the longitudinal axis Z-Z. The jacket pipe 17 also has an inner diameter that is suitably sized so as to allow the auger 9 to pass serially through it. In the illustrated example, the jacket pipe 17 has a longitudinal or main axial extension with respect to the coupling portion or half-joint 16 and with respect to the cutting crown 18. Clearly, the jacket pipe 17 is made so as to be sufficiently robust to transmit to the crown 18 the cutting actions for drilling: torque and thrust at the same time so as to be sufficiently light to not have an excessive impact on the stability of the drilling equipment during operation.

Optionally, the jacket pipe 17 can also be made with a double wall, in other words it can include an outer pipe and an inner pipe, in particular having walls of reduced thickness so that there is no presence of inner or outer steps in the jacket pipe 17, and therefore it takes up a configuration such as to ensure the continuity of the inner diameter and of the outer diameter passing from the cutting crown 18 to the jacket pipe 17 itself. With this solution the outer and inner diameter are similar and the advancing of the pipe in the excavated hole and that of the auger takes place without stranding.

The cutting crown 18 has a substantially hollow cylindrical shape, for example with a circular cross section, extending around the longitudinal axis Z-Z. Moreover, the cutting crown 18 has an inner diameter that is sized so as to allow the auger 9 to pass axially beyond its terminal end. In this way, the drilling equipment is able to make the auger 9 operate also in sections of unpiped depth.

According to the type of ground to be drilled, the cutting crown 18 can also comprise cutting means (not numbered), in particular provided at the front, on the outside and/or inside with respect to its terminal end. In this way, the excavation assembly is able to extend the diameter of the drilling even beyond the outer diameter of the casing pipe 10, thus ensuring that the friction between ground and outer surface of the casing pipe 10 are low to allow the excavated pile to be made with lower stresses.

As an example purely for indicating purposes, the cutting crown 18 can have a height or axial extension of between about 500 mm and 2500 mm, whereas the diameters can vary indicatively from 300 mm to 1500 mm. On the other hand, as regards the transversal dimensions, again as an example, the cylindrical wall of the cutting crown 18 has a thickness S18 generally comprised between about 20 mm and 60 mm. In particular, the thickness S18 is determined so that the cutting crown 18 is able to house the excavation teeth having the desired characteristics (for example, the diameter, the thickness and the type of teeth). Moreover, in the casing pipe 10 the cutting crown 18 is generally the element that tends to wear out most often and therefore requires frequent restoration; also for this reason, the cutting crown 18 can also have a connection system with the jacket pipe 17 that is of the removable type, therefore different from the welding quoted earlier.

With particular reference to FIG. 4, the structure of the casing pipe 10 preferably involves the presence of an intermediate step 18*a* located between the cylindrical wall of the jacket pipe 17 and the cylindrical wall of the cutting crown 18. Advantageously, the step 18*a* is made between the inner part of the wall (narrower) of the jacket pipe 17 and the inner part of the walls (thicker) of the cutting crown 18, for example making a substantially frusto-conical side surface that tapers in the direction of the terminal end of the cutting crown 18.

In the example illustrated in the figures and purely for indicating purposes, hereafter we quote some example dimensions relative to the casing pipe 10.

The outer diameter $D_e$ of the casing pipe 10, preferably coinciding with the outer diameter of the jacket pipe 17 and of the cutting crown 18, is equal to about 40 inches, in other words about 1016 mm. The casing pipe 10 preferably has a single thickness and with an inner step 18*a*.

Typically, the thickness S17 of the cylindrical wall of the jacket pipe 17 is comprised between about 8 mm and 15 mm. In the illustrated example, the inner diameter $D_{i1}$ of the jacket pipe 17 is equal to 936 mm (hypothesising a thickness S17 equal to 10 mm).

The cutting crown 18 has a thickness S18 equal for example to about 30 mm, and therefore the inner diameter $D_{i2}$ of the crown 18 is about 956 mm (in other words it is about 60 mm less than the outer diameter).

As it can be seen in the figures, the cutting crown 18 has an inner diameter $D_{i2}$ that is advantageously smaller than the inner diameter of the jacket pipe 17. This makes it possible to guide the auger 9 on a lower end section thus with greater precision in vertical orientation and allowing the reduction of the overall friction between auger 9 and casing pipe 10 in virtue of the presence of the inner step 18*a*.

Based on the dimensions and levels quoted above and taking into account the clearances and the precision of construction that are generally required and applied in the field, the auger 9 can have an outer diameter not greater then about 940 mm so that the auger 9 can pass freely, crossing the cutting crown 18 axially.

In light of the above, the difference between the value of the cuter diameter $D_e$ (about 1.016 mm) of the casing pipe 10 and the outer diameter (about 940 mm) of the auger 9 is about 76 mm. The aforementioned difference represents the difference in diameter in a drilling made by the equipment beyond the piped depth, which substantially corresponds to the difference in outer diameter (or "step") existing in the excavated pile made in the aforementioned drilling.

The problems due to the aforementioned difference in diameters are particularly, but not only, great in the case of barriers or partitions formed from intersecting piles.

In greater detail, the effects on the load-bearing capacity of each excavated pile due to the difference in diameter must be evaluated at the design stage also based on the shape and optimal configurations to be given to the reinforcement cages that can be inserted in the primary piles and/or in the secondary piles, on the amount of concrete to be cast, on the actual penetration in the ground of the intersecting piles in mutually adjacent positions up to a guaranteed depth. Indeed, when a barrier or a partition of intersecting piles is made through the equipment represented in FIG. 2, we have an arrangement, in which the piles located adjacent to one another have, at the unpiped depth, a smaller diameter (and therefore a greater mutual distance) by about 50-120 mm with respect to the diameter that they have in the section of piped depth. Clearly, the design choice of the distance between centres present between adjacent rules is greatly affected by this difference in diameters, as well as the precision of orientation or verticality of the drilling obtained.

In light of the above, in order to reduce the problems and the drawbacks due to such aspects, it is known to reduce the distance between centres of adjacent intersecting excavated piles. However, this provision involves taking longer to make the piles, greater consumption of concrete, a greater amount of primary piles to be demolished when the secondary piles are made. This in turn leads to a substantial increase in production costs, which raises substantial economic problems and considerations in making barriers or partitions of excavated piles.

For the sake of completeness, hereafter we give a summary of the technical contents of some patent documents belonging to the prior art and concerning the technology of making excavated piles.

U.S. Pat. No. 4,193,462 describes the excavate of a pile by using an inner auger and a casing pipe, specifically for rocky ground. The problem of excavating a greater diameter, comparable with that of the pipe, with the auger is solved by placing two cams on the bit that are moved in the radial direction by a pivoting movement. The rotation in a cutting sense with the friction generated by the ground on the cams, promotes their enlargement, whereas the extraction on an inclined plane pushes the cams to close, going back in the inner shape of the casing pipe. Such a system provides the use of pivoting mobile means, which have known problems due to the presence of mobile parts in very dirty environments and in the presence of cement mixtures. Such solutions, particularly if not motorised, do not give the certainty of occurred opening of the cam and therefore there is no guarantee that the greater diameter is really made or that it is maintained for the entire length of the "unpiped depth".

U.S. Pat. No. 4,494,613 describes an excavation device of a pile in which the enlargement of the diameter made by the auger is carried out by using two collapsible blades that come out to the maximum diameter through the effect of the resistance with the ground. Also in this case, the maximum diameter is obtained with additional mobile means, equipped with pins that could get stuck due to the presence of cement and ground and they may not be able to guarantee the opening of the cutting elements.

Italian patent application TO94A000041 to the same Applicant describes equipment suitable for drilling with a piped auger and prolongation of the excavation with an end tube. Such equipment is substantially analogous, in its operating principle, to the example discussed earlier in the present description and illustrated in FIG. 2. However, the aforementioned Italian patent application does not describe or suggest a device suitable for making an increased excavation diameter in the portion excavated by the advancing auger.

European patent application EP 0 974 729 to the same applicant describes an excavation device sliding inside a casing pipe; such a device comprises a spiral-shaped auger welded around a tubular core. The auger ends at the bottom at a first horizontal plate to which it is fixedly attached and below which the tubular core extends defining a lower end portion. The lower end portion has a rotary unit fitted onto it, equipped with a cylindrical excavation bit and offset with respect to the central axis of the device. Such a rotary unit is provided with a second horizontal plate that comprises an abutment portion for the first horizontal plate. In this way, during the excavation step, the auger and the tubular core begin to describe a combined movement of relative rotation between the plates and of translation downwards until the first plate goes into abutment with the abutment portion of the second plate, also pulling the rotary excavation unit, into rotation as an enbloc with it. During said excavation step the excavation bit must be arranged outside the pipe. The excavation device described by the aforementioned European patent application does not allow excavation when the excavation bit is inside the casing pipe, because the excavation bit is counter-rotated and this movement opens a passage for discharging the cement. Therefore, this configuration inside the pipe can only be used for the casting step.

SUMMARY OF THE INVENTION

A purpose of the present invention is to make a helical drill bit for an auger of a ground drilling assembly, in particular for building excavated piles, and a drilling method that uses such a bit, which are able to solve the aforementioned and other drawbacks of the prior art, and which at the same time can be made in a simple, safe, effective and cost-effective manner.

According to the present invention, this and other purposes are accomplished through a drilling tool bit according to the attached claim 1 and through a drilling method according to the attached claim 14.

In particular, by using a bit and a drilling method according to the present invention, it is possible to make a drilling the diameter of which is substantially the same along the whole extension of its longitudinal axis, in other words in the section of piped depth and in the section of unpiped depth. Consequently, based on the teachings of the present invention, it becomes possible to make a partially piped excavated pile at full depth, i.e. the diameter of which is constant for its entire longitudinal axial extension.

It should be understood that the attached claims constitute an integral part of the technical teachings supplied here in the following description regarding the present invention.

BRIEF DESCRIPTION OF THE DRAWINGS

Further characteristics and advantages of the present invention will become clear from the following detailed description, given purely as an example and not for limiting purposes, with reference to the attached drawings, in which:

FIGS. 13 to 16 show some operating steps of an example of a drilling method according to the present invention.

DETAILED DESCRIPTION OF THE INVENTION

Figure 5:
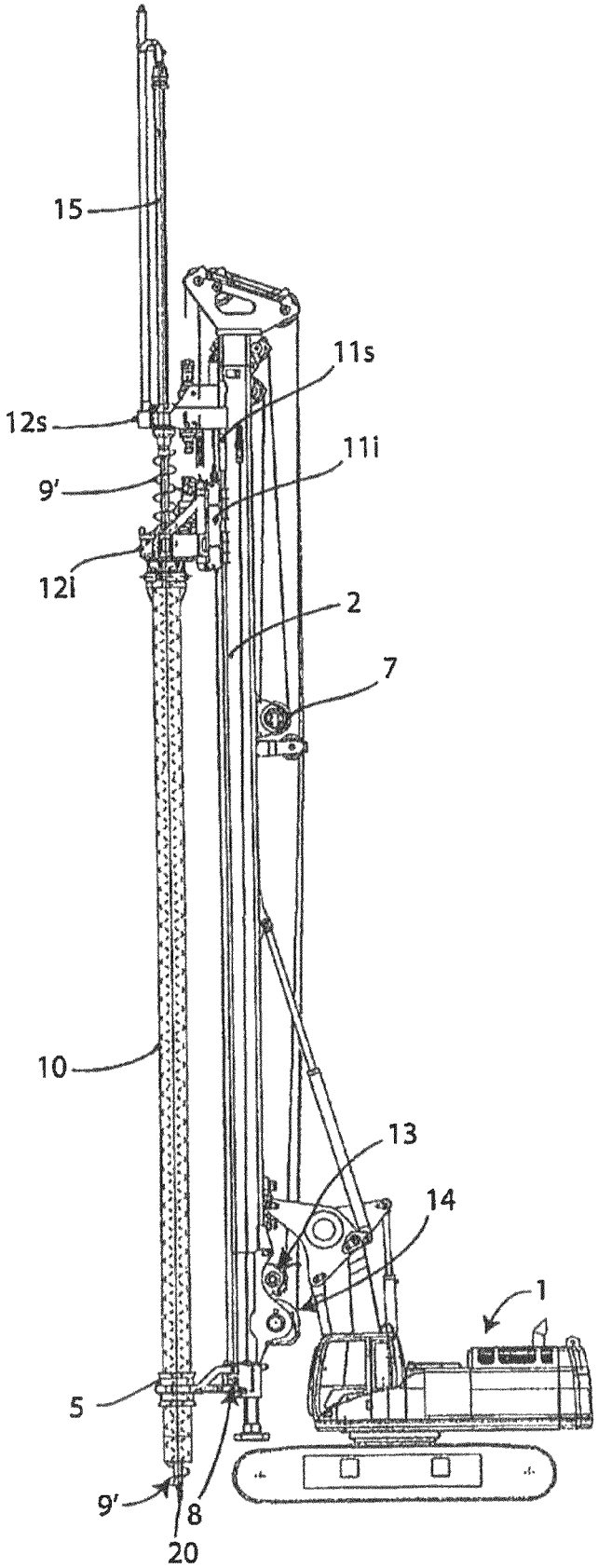
FIG. 5 is a schematic side elevation view of an example of drilling equipment including a drilling auger equipped with an example embodiment of a bit made according to the present invention.

With reference to FIG. 5, an example of drilling equipment including a drilling tool equipped with an example embodiment of a bit according to the present invention is illustrated. Such a tool is wholly indicated with 9' to distinguish it from the drilling tools illustrated in combination with the equipment of the previous figures and made according to the prior art.

Figure 2:
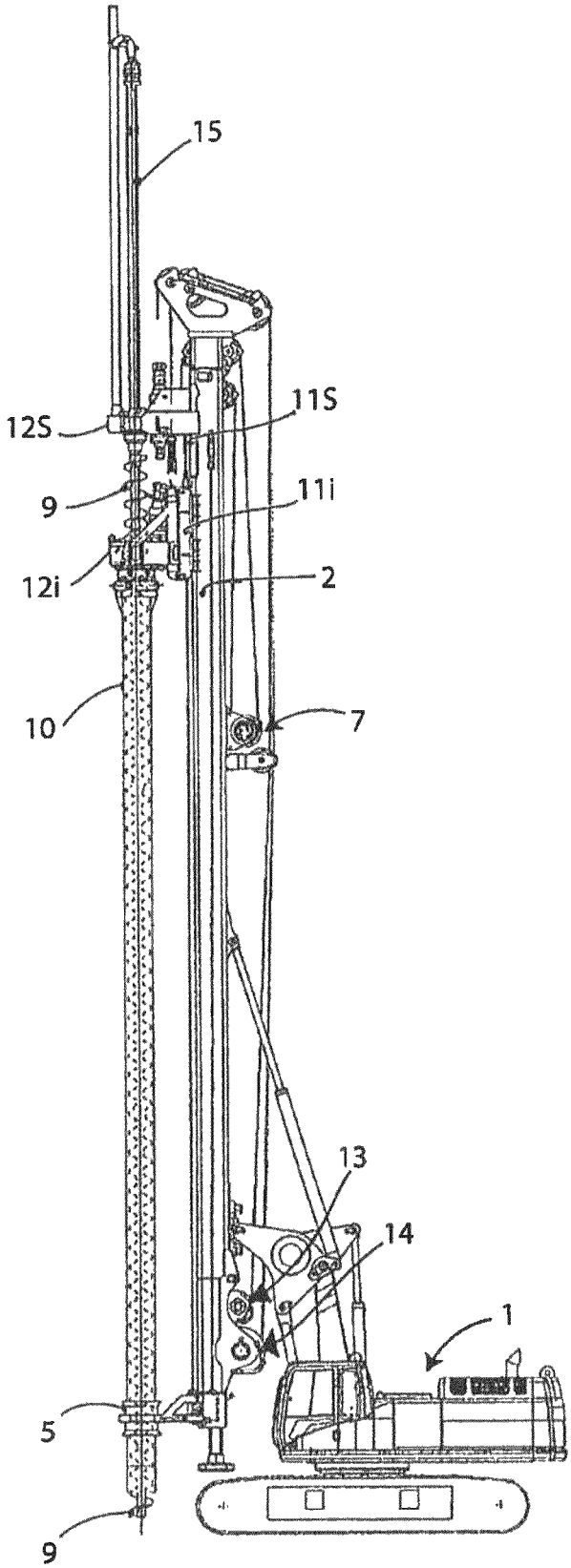
Figure 3:
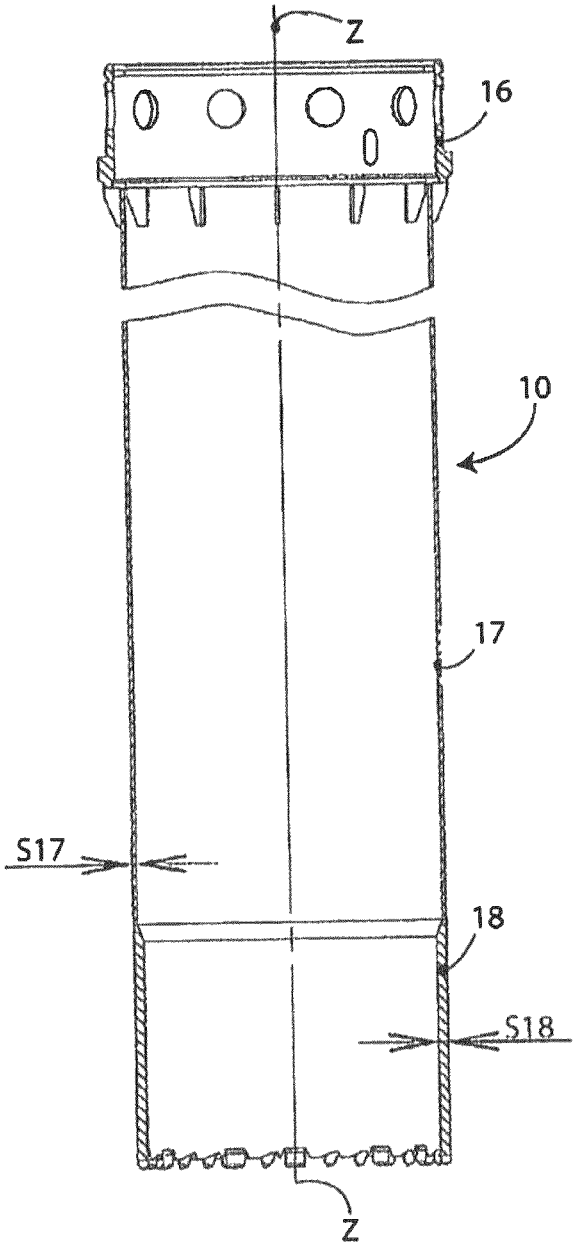
FIG. 3 is a longitudinal or axial section view of a casing pipe of the drilling equipment illustrated in FIG. 2.
Figure 4:
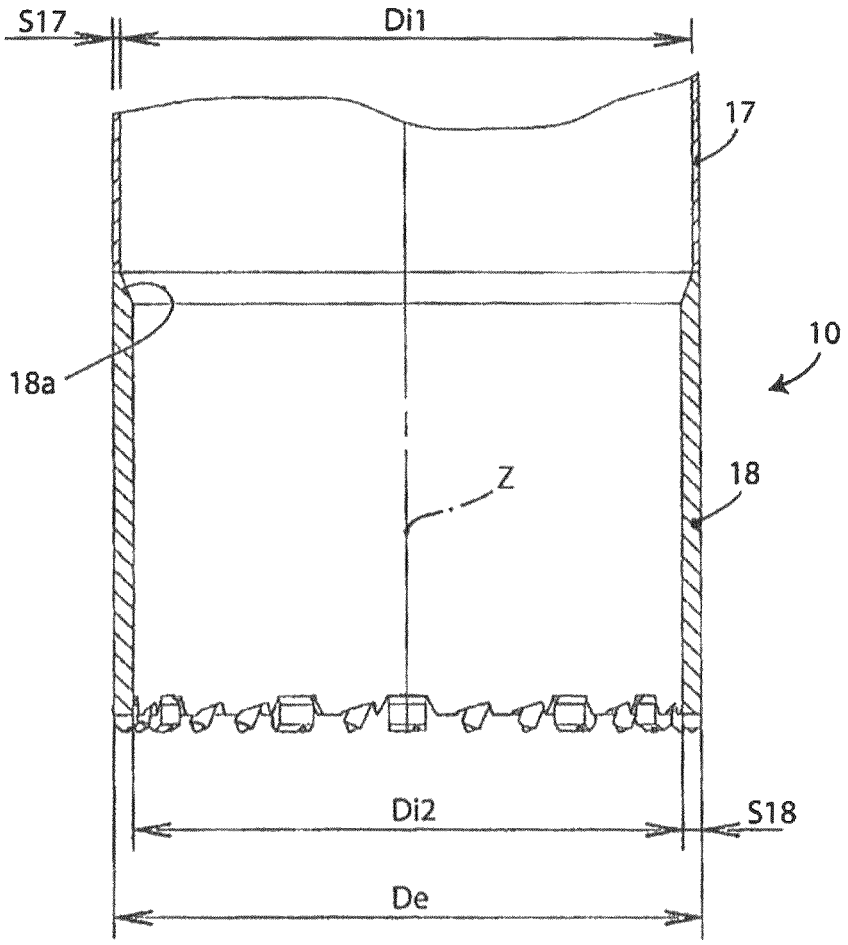
FIG. 4 is an enlarged view that illustrates a bottom section of the casing pipe shown in FIG. 3.

Details and elements that are similar—or having an analogous function—to those of the example of equipment made according to the prior art and illustrated in FIGS. 2 to 4, have the same alphanumeric references associated with them. In order to be brief, the description of such details and elements will not be repeated again hereafter, but we refer to what has been quoted earlier in the presentation of the technological background relative to the present invention.

As a whole, the drilling tool or auger 9' defines a helical or Archimedean screw-type structure extending cylindrically around a longitudinal axis X-X, for example defining circular-shaped spirals when observed in plan that are centred with respect to the longitudinal axis X-X, and it is supported and able to be actuated in thrust, traction and rotation, in a per sé known way, through the upper drive head 12*s*.

In the illustrated embodiment, the drilling tool 9' is adapted to be set in rotation by the drilling drive head 12*s* independently from the "intubating" drive head 12*i* that, on the other hand, controls the rotation of the casing pipe 10. In a preferred manner, the auger 9' is set in counter-rotation with respect to the direction of rotation of the casing pipe 10 (for a person observing from above the equipment illustrated in the drawings, the rotation imparted on the drilling tool 9' is generally directed in the clockwise direction, whereas the rotation imparted on the casing pipe 10 is usually directed in the anti-clockwise direction).

In greater detail, the drilling tool 9' has a helical drill bit or auger bit 20 associated or associable, in particular positioned beneath, with a support portion 23 adapted to be connected with the drilling drive head 12*s* on the opposite side to the helical drill bit 20. The bit 20 and the support portion 23 extend mainly according to a longitudinal direction and at their periphery they define the aforementioned helical or Archimedean screw-type structure. Advantageously, but not necessarily, the support portion 23 and the helical drill bit 20 are two distinct elements stably connected together, for example in a removable manner. According to a less preferred variant, the support portion 23 and the helical drill bit 20 can be made in a single piece, thus forming a monolithic auger 9'. However, in this last case, the solution would be less expensive but the restoration maneuvers of the helical drill bit 20 could be more difficult.

Figure 6:
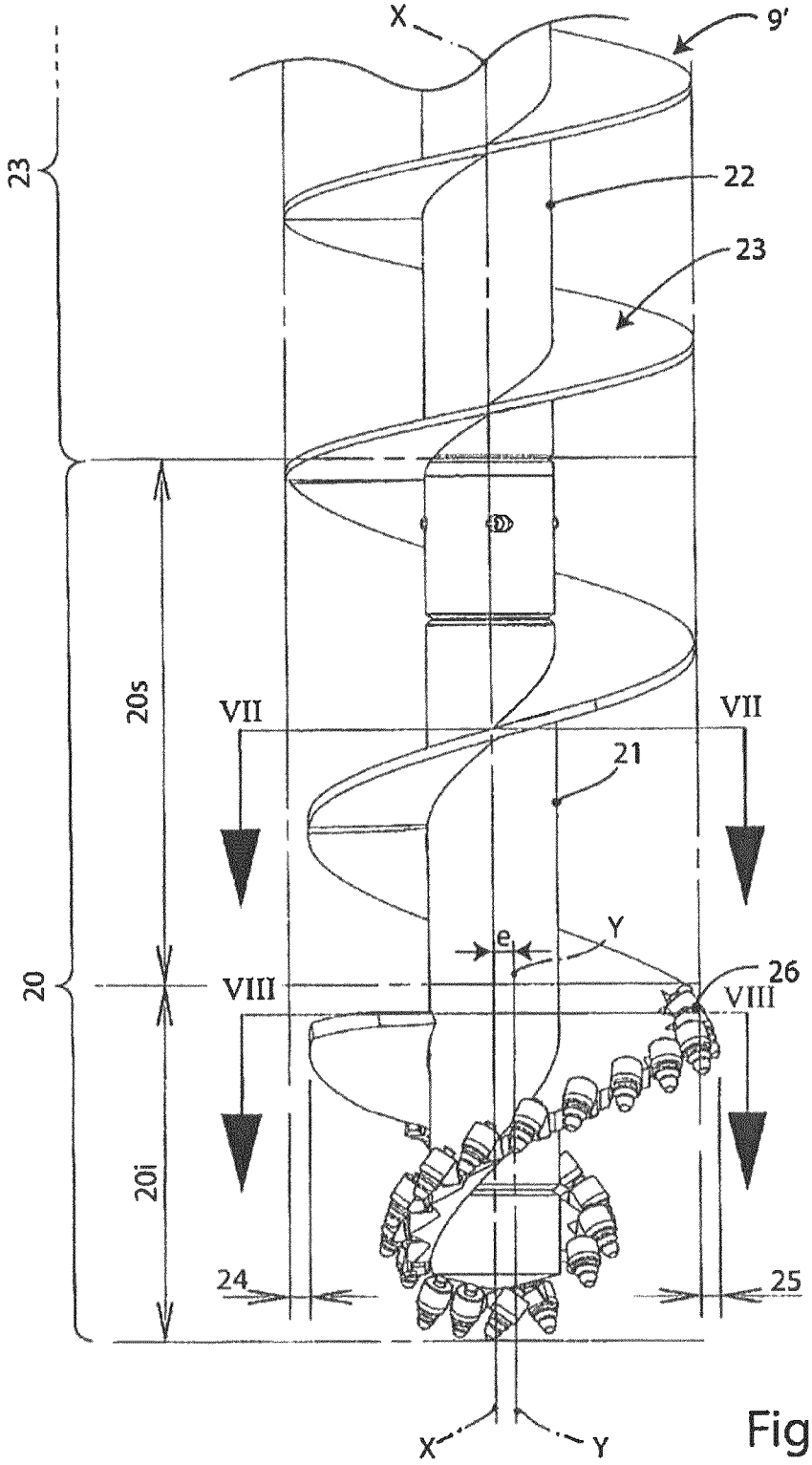
FIG. 6 is a partial side elevation view of the auger shown in FIG. 5.

With reference to the embodiment illustrated in FIG. 6, the bit 20 has at least one lower helical end section 20*i* of the helical structure made peripherally by the auger 9'. The helical end section 20*i* is adapted to always remain fixedly connected to the support structure 23 and in particular to rotate about the longitudinal axis X-X of the auger 9' as a unit with the support structure 23, so as to make a drilling in the ground. Therefore, the helical drill bit 20 and all the parts of which it consists are fixedly connected and form a single body with the auger 9', and are such as to not have any relative movement with respect to each other, in particular that of rotation. The relative rotation between the excavation auger bit 20 and the auger 9' or the support portion 23, indeed, would introduce clearances in the coupling with imprecisions on the excavation direction. Moreover, in the case of inversions of rotation for particularly rough excavations, the clearances and the collisions would damage the mechanical parts in temporary contact. In any case, the relative movement between the parts would produce an offsetting of the helical planes of the auger 9' (at the support portion 23) and of the helical bit 20, causing openings, interruptions and misalignments that would hinder the excavation efficiency and the fluid passage of the ground rising on the auger. Therefore, the auger 9' and the auger bit 20 behave at least temporarily, during the operating excavation steps, like a single element and they can in any case be dismounted from one another.

Furthermore, the helical end section 20*i* extends around an extremity axis Y-Y that is offset with respect to the longitudinal axis X-X of the auger 9'. In other words, the extremity axis Y-Y is offset with respect to the longitudinal axis X-X. Preferably, the extremity axis Y-Y is offset transversally (or radially), or spaced, with respect to the longitudinal axis X-X. Such an offsetting value between the axis X-X and the axis Y-Y is defined and remains constant in all working conditions. In the illustrated embodiment, the extremity axis Y-Y is parallel, or eccentric, with respect to the longitudinal axis X-X.

In particular, the support portion 23 and the helical drill bit 20 comprise a supporting trunk or shaft 22 and, respectively, an excavation trunk or shaft 21 made with a hollow cylindrical, for example circular, shape and from the periphery of which the helical structure of the auger 9' extends peripherally.

Figure 8:
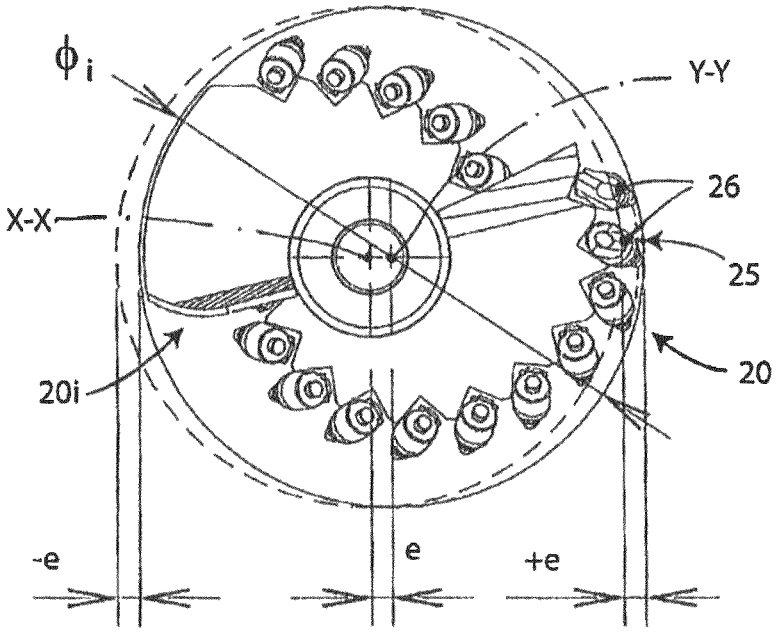

With reference in particular to FIGS. 6 and 8, the helical end section 20*i* has a tapered helical extension, preferably substantially conical or frusto-conical, with respect to an axis of extremity or of eccentricity Y-Y located eccentrically with respect to the longitudinal axis X-X. In the illustrated embodiment the longitudinal axis X-X coincides with the axis of the trunk 21 and/or 22. Moreover, in a preferred manner, the extremity axis Y-Y is substantially parallel to the longitudinal axis X-X.

Preferably, the spirals defined by the helical end section 20*i* have a circular shape, in particular with progressively decreasing radial size, observed in plan with respect to the extremity axis Y-Y. Said spirals wrap around the extremity axis Y-Y for at least one quarter turn, preferably for a value comprised between one half turn and one turn.

As an alternative to what has been outlined above, the aforementioned helical end section 20*i* could also have a cylindrical helical extension, but in this case the front cutting surface, coinciding with the lower transversal surface, should be substantially flat and not conical (concave or convex). In this case, the bit 20 would find it difficult, to keep the excavation direction as straight as possible, due to the lack of said conical centering section.

The size of the eccentricity of the axis Y-Y of the helical end section 20*i* of the auger 9' is indicated with reference letter "e". In the illustrated embodiment, thanks to the eccentricity "e" between the axis X-X and the axis Y-Y, the helical end section 20*i* extends transversally with a protruding portion 25 thereof beyond the rest of the helical structure defined by the auger 9'. Therefore, by suitably sizing the eccentricity "e", the helical end section 20*i* defined by the helical drill bit 20 is able to make a drilling having an actual diameter that is greater than that which can be obtained through the action of the other turns that are carried by the rest of the helical structure wholly defined by the auger 9' and that are generally concentric with the longitudinal axis X-X of the trunk 21 and/or 22.

Preferably, the protruding portion 25 extends for at least 180° of the helical extension defined by the helical end section 20*i*.

For example, the protruding portion 25 has a maximum protrusion at least equal to the size of the aforementioned eccentricity "e".

Preferably, the protruding portion 25 is made as a peripheral arched prominence, for example having the concavity facing radially outwards. In greater detail, in the illustrated embodiment the protruding portion 25 has a so-called "crescent moon" shape, the arched protrusion of which is gradually variable from a maximum value in a middle portion of the arc and equal to the eccentricity "e" up to a zero value at the ends of the arc diametrically opposite one another and located at about 90° from the positioning of the maximum protrusion.

Preferably, the helical end section 20*i* comprises at least one drill tooth 26 located at the protruding portion 25 so as to be able to extend radially even beyond the latter. The eccentricity "e" thus carries the drill tooth 26 at a distance from the longitudinal axis X-X such that it can excavate at a distance very close to the outer diameter of the casing pipe 10 and in particular even slightly greater and comparable to the excavation diameter made by the cutting crown 18 of such a casing pipe 10. Basically, although the helical drill bit 20 has a smaller diameter size (for example equal to 940 mm) than the diameter size of the casing pipe 10, such a bit 20 is able to make a drilling in which the diameter in the section of unpiped depth (obtained through the action of just the auger 9') corresponding to the diameter displayed in the section of piped depth (obtained through the action of the casing pipe 10 at its cutting crown 18).

Purely as an example and with reference to the levels quoted earlier in the present description, the helical end section 20*i* when observed in plan from above has a diameter $\Phi_i$ equal to about 940 mm.

In the illustrated example embodiment, the support portion 23 defines a proximal section of the helical structure of the auger 9'. The proximal section of the support portion 23 has a cylindrical extension centred around with respect the longitudinal axis X-X. For example, such cylindrical extension has spirals having a circular shape when observed in plan with respect to the longitudinal axis X-X. Advantageously, the diameter defined by the proximal section is equal to the diameter $\Phi_i$ of the eccentric helical part 20*i*, and its centre is located on the longitudinal axis X-X and coinciding with that of the trunk 22.

The helical end section 20*i* can be made with a single-start screw or, preferably, with a double-start screw. In the case in which a single-start screw is used, the drilling operation is less preferred, even though it is simpler and more cost-effective, since it would not be effectively balanced; in fact, in this case the cutting stresses would be concentrated just on one side of the helical end section 20*i*, along the leading edge for drilling provided with teeth 26, those that carry out the enlargement beyond the natural diameter of a cylindrical helical drill bit, aligned with its own trunk. In this case, it is possible to generate lateral force components such as to make the entire helical structure deviate, making it vibrate or making it subject to bouncing when operating in particularly hard ground. On the other hand, in the case in which two-start screws are used, they are preferably mounted opposite to each other, to balance the cutting forces. In this last case the excavation teeth are placed on two equal and opposite cutting lines. The drilling is more regular and continuous and the helical drill bit 20 tends to stay more vertical, particularly when passing through hard ground, even if such an operation becomes more expensive with respect to the single-start screw.

Preferably, the eccentricity "e", when it is required for the helical drill bit 20 to drill to the same cutting diameter as the crown 18, is substantially close to half the difference between the outer diameter $D_e$ of the casing pipe 10 (but more specifically of the outer diameter corresponding to the diameter cut by the teeth of the cutting crown 18) and the outer diameter of the circular cylindrical extension of the helical support structure defined overall by the auger 9'. Considering the example of levels and dimensions quoted earlier in the present description, a value that can be determined for the eccentricity "e" is close to about 38 mm (for example 40 mm). In particular, if the excavation means with which the cutting crown 18 is equipped were such as to cut a significantly greater diameter than the outer diameter of the cutting crown 18 of the jacket pipe 17 or of the half-joint 16, then the value of the eccentricity "e" can be selected to be proportionally larger. Once the value of the eccentricity "e" has been assigned, it is kept constant during all of the operating and non-operating steps.

Figure 7:
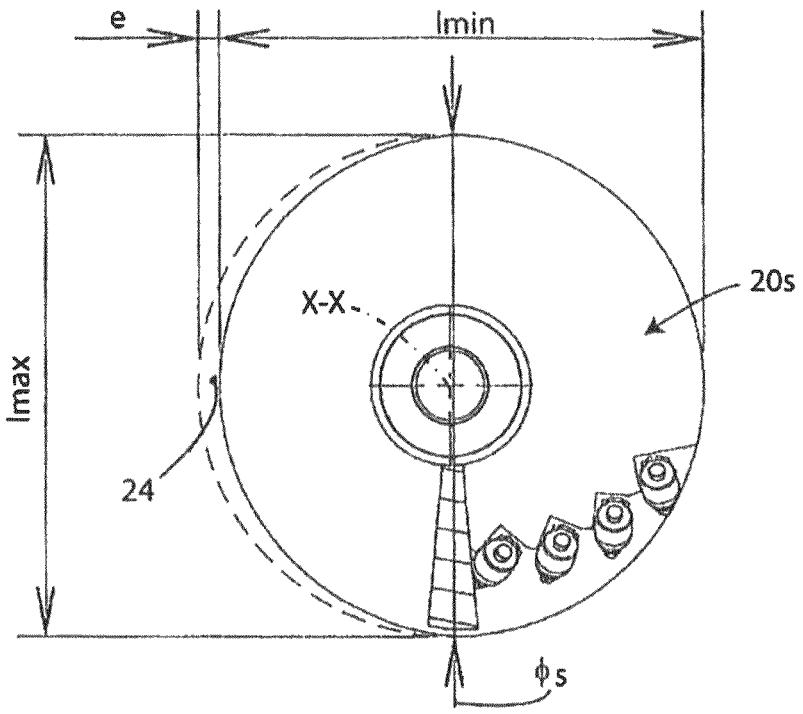
FIGS. 7 and 8 are cross section views made according to the section lines VII-VII and VIII-VIII, respectively, of FIG. 6.

With reference in particular to FIGS. 6 and 7, the helical structure defined by the auger 9' additionally comprises an intermediate section **20*s* located in a proximal position with respect to the helical end section 20*i*. More specifically, the intermediate section 20*s* is located between the proximal section (belonging to the support portion 23) and the lower helical end section 20*i*. In particular, we can assume by convention that after the protruding portion 25 in which the excavation teeth 26 having the maximum cutting diameter are housed, the lower part or the intermediate section 20*s* begins. Of course, this is a convention, given that there is greater flexibility in defining this section, also in relation to the very similar geometry with the support portion 23. The intermediate section 20*s* has a helical extension substantially centred around the longitudinal axis X-X of the auger, coinciding with that of the trunk 21**.

The intermediate section **20*s* has a spiral defining a shape, when observed in plan with respect to the longitudinal axis X-X, that has a smaller site than the rest of the helical structure defined by the auger 9'. In other words, the aforementioned transversal shape of the intermediate section 20*s* does not extend transversally beyond the shape defined by the rest of the helical structure, but remains within the shape defined by its proximal section and its helical end section 20*i*. The choice of the diameter of the auger, in particular of the support portion 23, is made as a compromise between clearances and verticality. Having preselected this value according to well-established techniques, it is advantageous for the intermediate section 20*s* to be smaller than the value that has been preselected, in order to allow the helical drill bit 20** to easily pass through and its optimal positioning with axis of eccentricity Y-Y arranged in the operating excavation configuration at the maximum diameter, in the unpiped drilling section.

Preferably, the cylindrical extension with smaller size of the intermediate section **20*s* has a shape, when observed in plan with respect to the longitudinal axis X-X, that is quasi-circular, the centre of which lies in said longitudinal axis X-X, the diameter $\Phi_s$ of which is the same as the diameter $\Phi_i$ of the helical end section 20*i* but the periphery of which has an arched recess 24 curving in transversally with respect to the rest of the circumference defined by the centred helical part 20*s*. For example, the arched recess 24** has its concavity facing radially outwards.

Preferably, the arched recess 24 extends for at least 180° of the helical extension defined by the intermediate section **20*s***.

For example, the arched recess 24 has a maximum inward curve at least equal to the size of the eccentricity "e" taken up by the helical end section **20*i***.

In the illustrated embodiment, the arched recess 24 substantially is shaped like a so-called "crescent moon", an which the inward curve of the arched recess is gradually variable from a maximum value in a middle portion of the arc and equal to the eccentricity up to a zero value at the ends of the arc diametrically opposite one another and arranged at about 90° with respect to sale maximum value.

By comparing the shape observed in plan of the intermediate section **20*s* and of the helical end section 20*i* shown in FIGS. 7 and 8, it can be seen how the arched recess 24 of the intermediate section 20*s* can advantageously correspond to the arched protrusion 25 of the helical end section 20*i* made and located in a diametrically symmetrical manner with respect to the arched recess 24. In the illustrated embodiment, such an arched protrusion 25 corresponds to the part of the circular cylindrical extension of the helical end section 20*i* that extends peripherally beyond the rest of the helical structure defined by the auger 9'**.

With particular reference to FIG. 7, the shape, when observed in plan with respect to the axis X-X, of the intermediate section **20*s* is that of a curve consisting of a semi-circumference and a semi-ellipse the centres of which both lie on the longitudinal axis X-X and the diameter and respective greater axis of which coincide and both have the value equal to the diameter of the circumference of the helical end section 20*i*. As an example, the quasi-circular shape of the intermediate section 20*s*** in plan from above has a greater dimension $l_{max}$ of about 940 mm (corresponding to the diameter of the semi-circumference coinciding with the greater axis of the semi-ellipse) and a smaller dimension $l_{min}$ (corresponding to the smaller axis of the semi-ellipse) of about 900 mm. In particular, the difference between $l_{max}$ and $l_{min}$ preferably differs by a value equal to the preselected value of the eccentricity "e".

The characteristics thus described of the intermediate section **20*s* contribute to facilitating the passage of the helical end section 20*i* of the helical drill bit 20 through the cutting crown 18 of the casing pipe 10, which has a smaller inner diameter $D_{i2}$ than the inner diameter $D_{i1}$ of the jacket pipe 17, because it is used as a guide for the auger 9'**.

The aforementioned helical drill bit 20 has excellent applicability particularly in medium-hard and compacted ground, in which tamping cannot be applied. Through the tamping technique, indeed, there would be a movement of ground from the centre of the hole towards its periphery; therefore, all of the excavated ground would be pushed progressively by the tamping tool, equipped with a shape having increasing cross section, against, the walls of the hole preventing the excavated material from coming out transported by the helical structure defined by the drilling tool or auger (the tamping area is a portion of tool with cylindrical section of equal diameter with respect to the pipe). In the case described here, on the other hand, the drilling tool must be able to remove ground, at least partially and it is conveyed towards the land surface through the helical structure defined as a whole that has the function of a Archimedean screw. Moreover, in applications for fences of intersecting piles, when making the secondary piles, tamping tools could not be used since the adjacent primary piles, in a state of partial or total curing (concrete in set state) could not operate. Also in this case it is necessary to carry out a removal of material through a cutting said removal operation, thus through a helical structure equipped with a suitable excavation assembly, selected based on the resistance of the ground.

In a preferred manner, the cutting crown 18 of the casing pipe 10 is sized in accordance with the configuration of the auger 9', in particular of the helical drill bit 20, in order to guide the helical structure defined by it during drilling.

In order to carry out the guide function, it is necessary to decrease as much as possible the internal clearance between cutting crown 18 and the helical structure wholly defined by the auger 9'. In other words, the radial distance between the cutting crown 18 and the auger 9', suitable for being set in mutual relative motion, must be reduced as much as possible, preserving the operating conditions of free relative sliding between the parts, which must take place as much as possible without stranding. For example, based on the levels and dimensions quoted earlier, such a radial distance can vary from a few millimeters to a few tens of millimeters. Indeed, when the helical drill bit 20 advances relatively with respect to the casing pipe 10, the cutting crown 18 is designed to keep the helical structure wholly defined by the auger 9' guided on the casing pipe 10 itself. However, if the internal radial clearance between the helical structure and the cutting crown 18 were substantially made null, the auger 9' would be in continuous contact with the inner surface of the cutting crown 18 and wearing and stranding would be produced. Conversely, if such a clearance were of excessive size, the helical structure would not be precisely guided and the axis of the drilling going forward would be deviated with respect to the desired orientation or verticality that substantially coincides with the axis Z-Z of the casing pipe 10.

Figure 9:
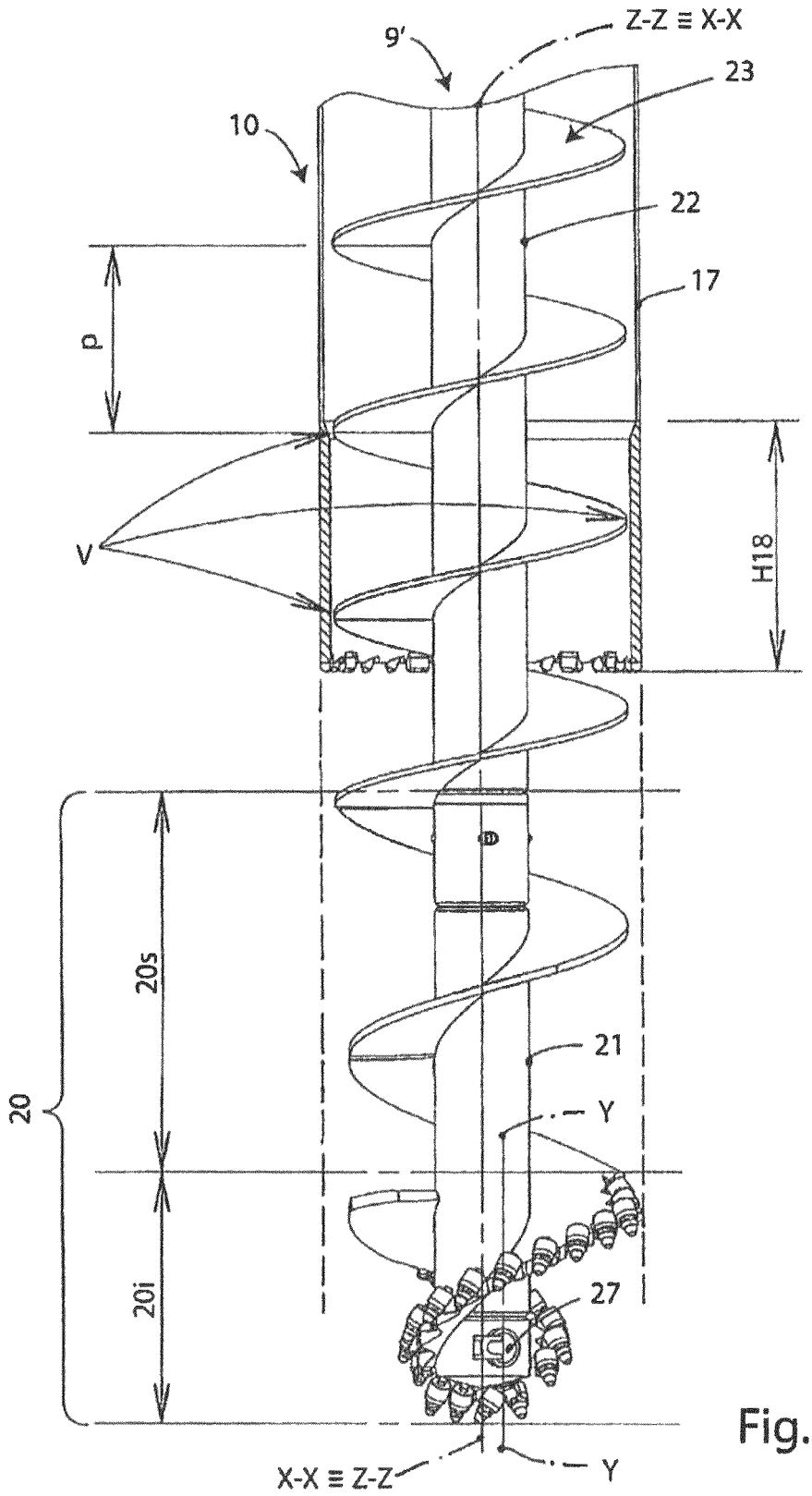
FIGS. 9 and 10 are partial side elevation views of an excavation assembly including the auger shown in FIGS. 5 to 8 in combination with a casing pipe carried by the equipment visible in FIG. 5.

With particular reference to FIG. 9, in order to avoid the auger 9' stopping by getting stuck in the cutting crown 18, on the one hand the helical structure has an intermediate section 20*s* as described above. In particular, the shape with smaller size of the intermediate section 20*s* makes it possible, during the advancing of the helical drill bit 20 beyond the bottom of the casing pipe 10, for the helical end section 20*i* not to become stranded against the inner surface defined by the cutting crown 18. For the aforementioned reason, the axial extension of the intermediate section 20*s* can be substantially greater than the height H18 of the cutting crown 18.

On the other hand, the cutting crown 18 preferably has a height H18 that is substantially greater than the pitch "p" of the proximal section (belonging to the support portion 23) of the helical structure defined by the auger 9', in this way confining at least the complete angular extension of 360°, of an entire turn, inside the cutting crown 18. In this way, a contact is made in at least three interface or contact points V, between such a proximal section defined by the support portion 23 and the inner surface defined by the cutting crown 18, obtaining a substantially balanced guide or support of the helical drill bit 20 keeping it in rotation around the longitudinal axis X-X. In other words the auger 9' is guided on the cutting crown 18 for at least one complete turn (in other words 360°) of its spiral.

The aforementioned contact points V can be considered as the points in which the resultant of the local contacts is applied, referring to a contact region limited to a relevant arc or sector.

In particular, in the step in which the helical drill bit 20 has completely come out from the lower end of the casing pipe 10, such an axis X-X (coinciding with the axis of the trunk 21) also coincides with the axis Z-Z of the casing pipe itself. Therefore, the axis Y-Y of eccentricity is moved, radially with respect to the theoretical axis of the pile (Z-Z) allowing the eccentric portion 25 to excavate to a greater radius, by using at least one tooth 26.

Figure 1:
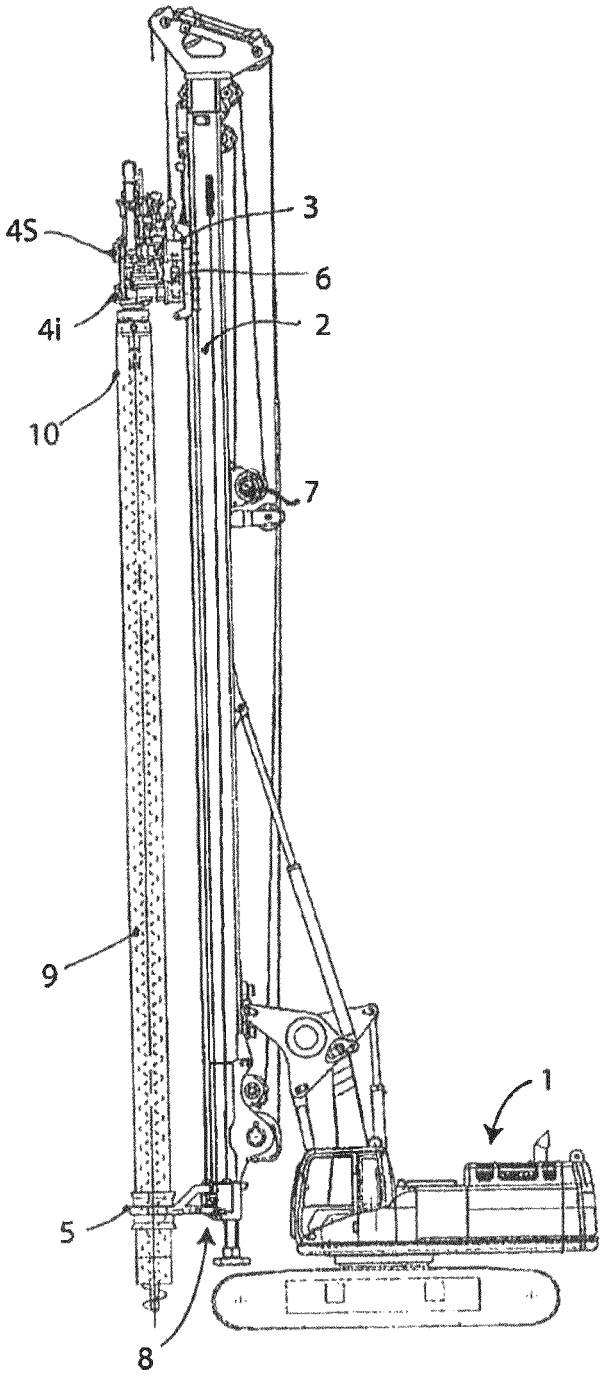
FIGS. 1 and 2 are schematic side elevation views of two examples of drilling equipment made according to the prior art.

Preferably, in this excavation step in which the helical drill bit 20 goes beyond the cutting crown 18, a tube 15 is installed on the auger 9', said tube being at least partially mounted above the upper drive head 12*s* and allowing the unpiped depth to be extended. In particular, the auger 9' itself could end at the top, and protrude beyond the upper drive head, with a section of auger, or with a section of auger having reduced size or furthermore with a simple elongated cylinder-shaped trunk (tube) that allows the piped depth to be increased through the "gripping" manoeuvre of the upper drive head. By "gripping" we mean that the upper drive head, being axially mobile, can slide along the protruding upper section of the auger 9' or of the tube 15 (if separate) to grip said auger 9' or said tube 15 at an upper locking point in order to be able to increase the excavation depth by an extent equal to the travel carried out by the drive head. Of course, the simple relative sliding between the drive heads, or rather between the auger 9' and the casing pipe 10, like that which can be carried out in FIG. 1 is considered as a "gripping" manoeuvre.

As quoted above, concerning this the intermediate section 20*s* can also have a shape, when observed in plan with respect to the axis X-X, having other shapes with respect to the one described above but with reduced site with respect to the helical end section 20*i* and to the proximal section, for example, the intermediate section 20*s* can have a circular cylindrical extension with a smaller diameter than that of the support helical structure 22*a*.

Preferably, the helical drill bit 20 is axially fixed to the support portion 23 through coupling systems that transmit the excavation forces, for example through hexagonal grooved profiles that prevent relative rotations about the axis X-X ensuring the transmission of excavation torque, and through axial holding pins that prevent sliding along the axis X-X, ensuring the transmission of the extraction pull of the auger. Advantageously, the helical drill bit 20 is able to thus be fixed in a removable manner to different types of support portions 23 available on the market.

As quoted above, the helical drill bit 20 defines a lower helical end section 20*i* of the helical structure defined by the auger 9'. Preferably, the helical drill bit 20 includes the helical end section 20*i* and the intermediate section 20*s*, for example they are made in a single piece.

According to an alternative embodiment (not illustrated) it is possible to devise an auger 9' the helical drill bit 20 of which comprises just the helical end section 20*i*, whereas the support portion 23 includes the proximal section and the intermediate section 20*s*.

According to a further constructive variant, it is possible to make the intermediate section 20*s* (belonging to the helical drill bit 20 or to the support portion 23) and the helical end section 20*i* in two distinct portions that can be removed from one another.

In the illustrated embodiment, the helical drill bit 20 is made as a hollow core and in its end part has a union 27 adapted for the concrete to come out through it. The anion 27 can be or any known type, for example a cap with chain, conical hatch with hinge, cylindrical hatch.

In the embodiment illustrated in FIG. 9, the helical end section 20*i* in the lower central part has a helical drill bit, called central bit or pilot bit 28, known in the field, generally of the dismountable and replaceable type, in which at least one cutting tooth carries out the excavation beneath the trunk 21. Said tooth is positioned on the central part (as indicated in FIG. 9) or it can be mounted on the periphery of the trunk 21, with the cutting end towards the inside (not represented).

Figure 10:
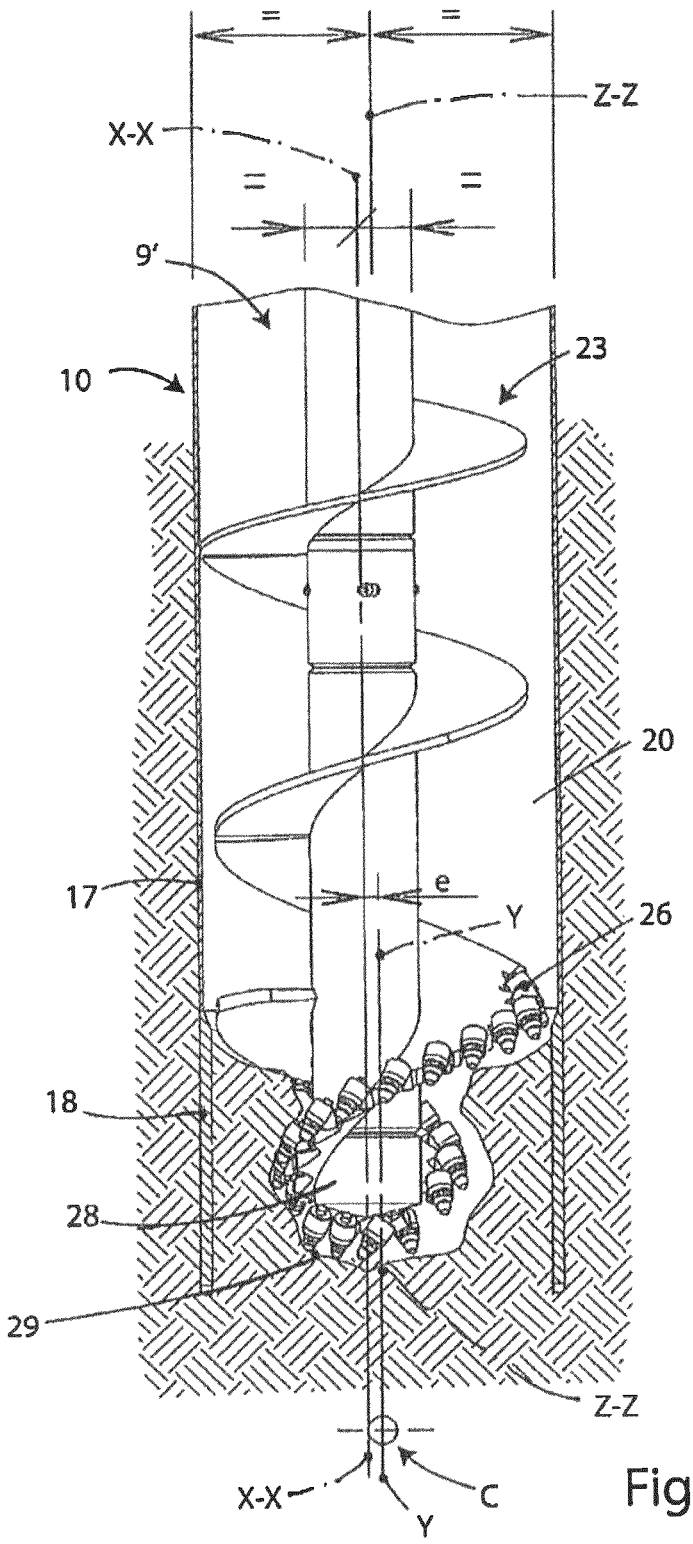

With reference to the embodiment illustrated in particular in FIG. 10, the helical drill bit 20 at its distal portion comprises a pilot bit 28, for example extending in a prevalently axial direction. In this case the pilot bit 28 tends to keep the drilling substantially aligned with the longitudinal axis X-X.

In particular, when the auger 9' including the helical drill bit 20 proceeds together with the casing pipe 10 in the drilling direction, the pilot bit 28 carries out a cylindrical excavation having a greater transversal extension with respect to its own transversal dimensions. This condition remains until the helical drill bit 20 is contained inside the casing pipe 10 daring piped drilling. Basically, the pilot bit 28 is designed to excavate simultaneously at the front (downwards) and at the side (for eccentric excavation) when it operates on the ground to be excavated in the space circumscribed by the casing pipe 10, and in particular on the cutting crown 18. Therefore, the longitudinal axis X-X in operation tends to deviate from the desired orientation and substantially coinciding with the axis Z-Z of the casing pipe 10 during piped drilling; in particular, during the rotation of the eager 9', when the helical drill bit 20 is in a retracted position with respect to the cutting crown 18, the auger 9' with its helical drill bit 20 has a deviation at the bottom equal to at least the value of the eccentricity "e". Consequently, the central bit 28 tends in this step to describe a circumference C of radius equal to the eccentricity "e".

In this configuration, the axes Z-Z and Y-Y coincide only near to the pilot bit 28. The longitudinal axis X-X, in at least this excavation configuration, on the other hand, takes up a deviated configuration, since if is kept centred at the too (coinciding with the axis Z-Z of the upper drive head 12*s*) whereas at the base, near to the pilot bit 28, it is laterally deviated by a value at least equal to the eccentricity "e".

Therefore, it is advantageous to size the overall helical structure of the auger 9' and the casing pipe 10 as a function of the eccentricity "e" taken on by the helical drill bit 20, for example taking info consideration, one or more of the following factors: rigidity and clearances that can be accumulated in relation to the overall helical structure, clearances on the drive heads 12*i*, 12*s* and on the respective trolleys 11*i*, 11*s* with respect to the tower 2, constructability or the helical drill bit 20, internal dimensions of the cutting crown 18, axial extension of the cutting crown 18, axial extension or the helical drill bit 20, construction diameters of the helical drill bit 20. This sizing leads to having a combination between the helical structure overall defined by the auger 9' and the casing pipe 10 such as to allow drilling in optimal conditions and with reduced consumption of the mutually moving parts due to relative sliding, to the elimination of joints and stranding during the relative translation, thus increasing the useful life of the helical drill bit 20 for greater efficiency, also ensuring that the maximum excavation diameter is maintained for the entire unpiped depth.

Figure 11:
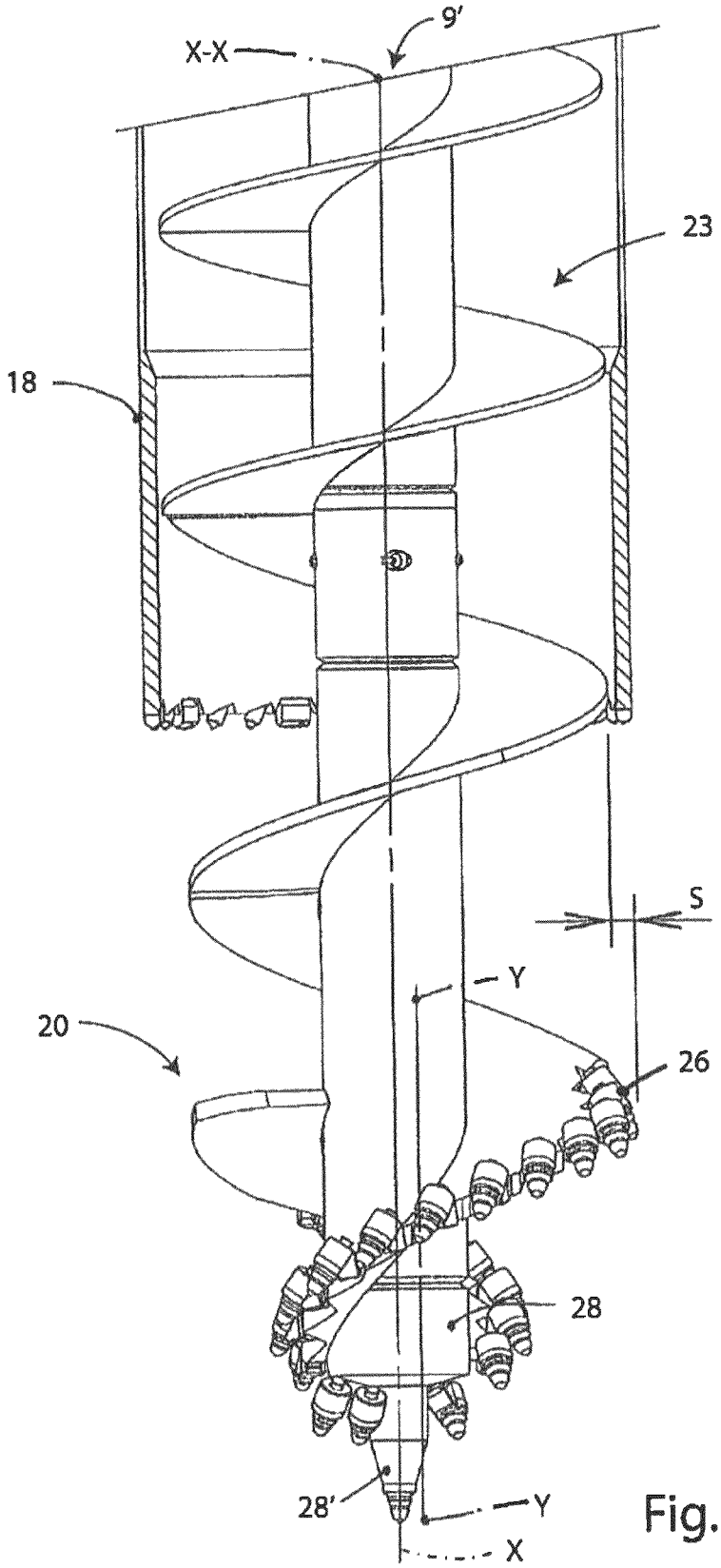
FIGS. 11 and 12 represent partial side elevation views of an auger shown in the previous figures in which the bit carries different variant embodiments of pilot bit.

With reference in particular to FIG. 11, when the helical drill bit 20 is positioned axially in an intermediate configuration in which the lower helical end section 20*i* is beyond the cutting crown 18 whereas the intermediate section 20*s* is still partially engaged inside the cutting crown 18, the helical drill bit 20 can begin to take up its natural excavation position, keeping the axis X-X aligned with the axis Z-Z of the casing pipe. Indeed, the pilot bit 28 (represented in a different variant from the previous ones) will tend to centre in the hole made by itself, which is concentric to the axis Z-Z of the casino pipe 10. From this moment, the axis X-X of the auger 9', the orientation of which is directed by the pilot bit 28 and by the cooperation between the proximal section and the cutting crown, becomes fixed and it no longer excavates laterally (i.e. it no longer describes a circular trajectory C concentric to the axis Z-Z of the casing pipe 10). In this step the rotation axis of the helical drill bit 20, and more generally the axis X-X or the auger 9', is no longer deviated but coincides with that of the hole being made, i.e. relating to unpiped drilling. In this configuration, correctly directed, only the eccentric part is represented by the helical end section 20*i* from which the excavation teeth 26 protrude, positioned on the protruding portion 25, which ensure the over-excavation "s" with greater diameter with respect to that of the remaining helical structure; in particular, such a greater diameter is substantially equal to that made by the cutting crown 18 of the casing pipe 10. The excavation teeth 26, are positioned along the outer periphery of the helical plane with conical extension.

In this transient step, in which the helical drill bit 20 goes completely beyond the cutting crown 18, the helical drill, bit 20 itself is guided in a not yet perfect manner because, if the support portion 23 is present, in the form with smaller size, it does not allow a perfect centering on the inner walls of the cutting crown 18. In any case, at least one pair of points, or rather a pair of portions are in any case in contact: at least one first contact is present between the intermediate section 20*s* and the crown 18 and a second is present between the support portion 23 (auger that reaches the top in connection with the upper drive head 12*s*) and the crown 18. Such contacts in any case guide the helical drill race 20, but preferably the guided support ensured by the support position 23 with at least 2 or 3 contact points is certainly more precise and effective in keeping the longitudinal axis Z-Z and that of the auger X-X coaxial.

Figure 12:
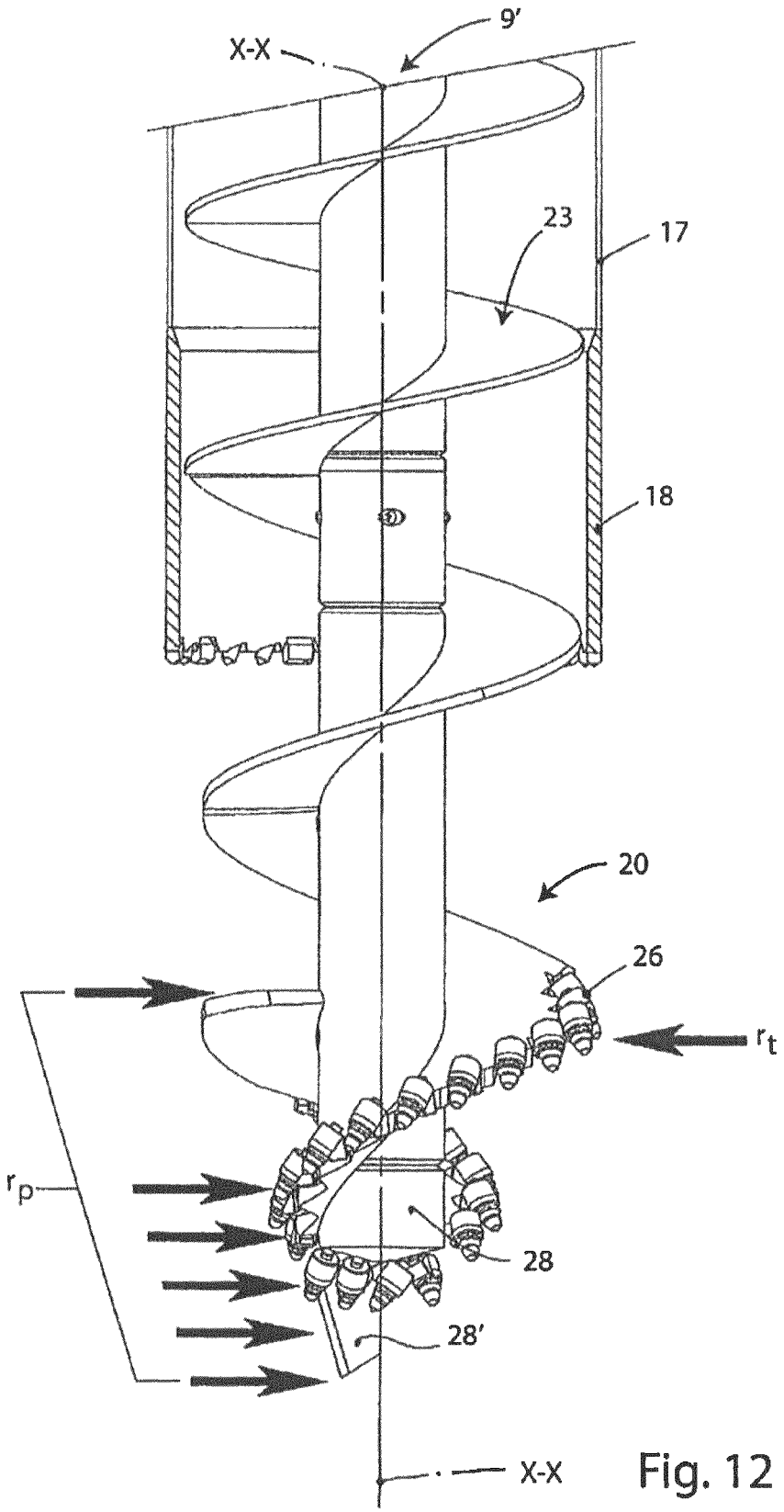

With reference to FIGS. 11 and 12, in order to facilitate its guide function, the pilot bit 28 can protrude more or less and have various shapes, also asymmetrical, indicated in the figures with reference numeral 28' (pilot bit end), all in any case intended to centre the helical drill bit 20 on the desired drilling axis (FIG. 11) or even to push (FIG. 12) the helical end section 20*i* against the wall of the drilling being made. Indeed, since the helical drill bit 20 has the helical end section 20*i* made like an eccentric portion, it will cut in the most protruding part, i.e. that in the direction of the eccentricity. However, through the effect of the reactions of the ground rt, the helical drill bit 20 will be pushed inwards—in other words towards the axis X-X—exerting a natural radial stress that leads to a reduction of its actual eccentricity value, and thus of its ability to excavate a greater diameter. Such an affect can also be counteracted by the shape of the selected pilot bit 28, for example in the region close to the helical end section 20*i*, and in greater detail, in the area that goes from the pilot bit 28 to the eccentric part of maximum bulk, indicated with rp (reaction section of the bit) of the helical end section 20*i*. In this operating mode, when the helical drill bit 20 protrudes axially beyond the casing pipe 10 (advanced position), it is thus necessary for the helical structure of the auger 9' to be as rigid as possible in order to keep the helical drill bit 20 aligned at the axis Z-Z with the casing pipe 10, overcoming the residual bending moments that form by the effect of the reactions or the ground. Moreover, the pilot bit 28 also exerts a centering and support function of the lateral thrusts due to reactions of the ground on the eccentric cutting part, and therefore it must be made to excavate moving forward, making it easier to keep its axis X-X coinciding with that Z-Z (of the casing pipe 10 and therefore of the pile being made). On the other hand, when the helical drill bit 20 works at least partially inserted in the casing pipe 10 (retracted position) it is the cutting crown 18 that cuts the portion of ground necessary to carry out the drilling suitable for making the excavated pile and the helical drill bit 20 located inside only has the function of demolishing the central core of ground. The central trunk of ground, in cylindrical form that is then ground down by the teeth indicated with 26 and by all the other teeth belonging to the cutting portion 20*i*, in order to be able to be extracted from the helical structure. On the other hand, when the helical drill bit 20 is in advanced position like in the case of FIGS. 11 and 12, it excavates the portion of ground, and therefore the teeth indicated with 26 and all the other teeth positioned along the cutting line of the lower section 20*i* (or two cutting lines in the case of double-start screws) on the lower portion of bit are shaped so as to cut the central part and ensure, also through an elongated shape, a favourable lateral containment guide in contrast with the reaction thrusts of the ground that act on the eccentric part of the helical structure defined by the auger 9'. Moreover, the helical structure itself of the auger 9' is developed angularly so as to counteract the eccentric thrusts of the cutting and allow a support on a region opposite that of the helical end section 20*i*.

A particularly advantageous configuration of the exert ration teeth 26 is that through which a regular passage of the helical drill bit 20 through the cutting crown 18 is obtained, with which efficiency is guaranteed in the eccentric excavation. For this it is preferable for more than one drill tooth 26 to carry out the drilling at the maximum diameter so as to regularize the diameter of such drilling and spread the maximum stresses over many cutting elements.

As stated above, the helical end section 20*i* can define a helical structure of the single-start screw or double-start screw type. In the first case the pitch of the helical structure defined by the helical drill bit 20 is advantageously equal to that of the helical structure of the proximal section made by the support portion 23, so as to not have variations in section that can produce problems for the evacuation of the ground. In the second case, which is preferable, the second auger opposite the first does not necessarily extend for the entire axial extension of the helical drill bit 20, but only in a lower region of such a helical drill bit 20. In the aforementioned front region in which both of the opposite start screws are present, the pitch between the start screws is reduced with respect to that of the helical structure made by the proximal section belonging to the support portion 23. The presence or a further opposite start screw also contributes to balancing the transversal thrusts and supporting the bit against such thrusts during the cutting produced by the eccentric element rp.

Finally, the arrangement of the teeth 26 can be such as to give them a configuration so that during cutting a force is generated that has a transversal component oriented towards the eccentric part of the bit 20, so as to counteract the thrusts of the ground and promote keeping the bit 20 in the position of maximum drilling diameter.

With reference to FIGS. 13 to 16 some steps of a drilling method according to the present invention are illustrated.

With reference to FIG. 13, the helical drill bit 20 is pushed in the excavation at the same time as the casing pipe 10, including the jacket pipe 17 and the cutting crown 18. In this condition the helical drill bit 20 is slightly retracted with respect to the bottom crown of the casing pipe (level indicated with H).

In this step the casing pipe 10 and the auger 9' rotate with a mutually opposing direction of rotation, the cutting crown 18 excavates the ground cutting the maximum diameter and the helical drill bit 20 has the function of merely breaking up the cylindrical column of ground and produce its evacuation. Indeed, the excavated ground is progressively conveyed towards the surface through the overall helical structure of the auger 9'. The inner surface defined by the walls of the cutting crown 18, narrower than that defined by the walls of the jacket pipe 17, is in contact with the turns of the helical structure defined by the helical end section 20*i* of the helical drill bit 20. In this way, the helical end section 20*i* tends to deviate the eccentric turns so as to align their centre (and therefore the eccentric axis Y-Y) with the longitudinal axis Z-Z defined by the cutting crown 18 itself, in the portion located lower down of the casing pipe 10. Consequently, as stated above, the axis X-X of the helical drill bit 20, near to the cutting crown 18 in this step describes a circular trajectory C having a radius equal to about the value of the eccentricity "e" exhibited by the eccentric helical portion 20*i*. The movement of the helical structure defined by the helical end section 20*i* of the helical drill bit 20 that occurs near to the pilot bit 28, generates forces capable of facilitating the breaking up of the ground, making its subsequent evacuation easy. Therefore, the pilot bit 28 is able to make an excavation imprint indicated with 20 that is greater than the actual diameter of the pilot bit 28 and that in any case has a conical, or at least convex, shape in longitudinal section. This step can go on until the "intubating" drive head 12*i* to which the causing pipe 10 is connected reaches the lower end stroke, corresponding to the maximum excavation depth of the casing pipe 10 (piped depth).

With reference to FIG. 14, just the casing pipe 10 is preferably lifted by a height at least equal to or greater than the axial extension, indicated with W, of the bit 20 (normally about 2-3 m) so as to carry the entire helical drill bit 20 below the casing pipe 10 (and the cutting crown 18). In this way, when the auger 9' is set in rotation, the helical structure of the proximal section 23 of the auger 9', the turns of which are in contact with the inner surface of the cutting crown 18 in at least three points V (or three sector arcs), guides the rotation of the helical drill bit 20, centering it. The auger 9' continues to be rotated in accordance with the previous step, whereas the casing pipe 10 is advantageously kept in counter-rotation with respect to the auger 9', to avoid the occurrence of high external friction with the ground that would cause the potential blocking of the auger 9' in drilling in the operating step.

With reference to FIG. 15, the helical structure wholly defined by the auger 9' is pushed (using the suitable motor means if its weight is not sufficient) against the bottom of the drilling being made so as to force the pilot bit 28 to take up a position centred in the excavation imprint 29 made by it in the step shown in FIG. 13. From this moment, the longitudinal axis Z-Z of the casing pipe 10, and the longitudinal axis X-X of the auger 9' coincide. In a preferred manner, the casing pipe 10 progressively lowers with the auger 9', until it goes back into the position taken up at the end of the step represented in FIG. 13.

With reference to FIG. 16, the helical drill bit 20 is able to proceed with drilling below the casing pipe 10, remaining in an advanced position, for the relevant section at the unpiped depth by virtue of the possibility of relative axial movement between the auger 9' and casing pipe 10. In this step, the helical drill bit 20 is advantageously guided and centred in at least one location positioned near to the inner surface of the cutting crown 18. This ensures the guiding through the contact with the turns of the helical structure defined by the proximal section 23 again at the at least three points (or three sector arcs), indicated with V. The simultaneous occurrence of these conditions, associated with the rotation of the two main components, puts the at least one external tooth 26 in a condition of being able to make a drilling diameter that can be varied as desired and preferably similar to the outer one of the casing pipe 10, in any case still greater than the diameter corresponding to that of the support section 23 or of the inner hole Di2 of the excavation crown.

Again in the step represented in FIG. 16, it is also possible to carry out the so-called "gripping" manoeuvre, i.e. the length of the helical support structure defined by the auger 9' is extended, hooking the auger 9' at a higher level than the previous one. Initially, the drilling drive head 12*s* is released from the auger 9' and the pipe extension 15 is connected to the top of the helical structure. It should be remembered that in a variant, the tube can also be made as an extension of the support portion 23. Thereafter, the drilling drive head 12*s* is made to rise along the mast 2, until it is locked at the top of the tube 15. In this way, it is possible to have an excavation extension equal to the travel carried out by the drive head between the original position and that arranged at a higher level. Of course, if is possible for the tube to have intermediate locking points and in this case the drive head 20*s* can lock on them without directly reaching the farthest, one arranged at the top (shorter travels of the drive head are thus required, but it is necessary to carry out more "grips".

The filling or the excavation at the end of drilling is carried out with concrete or cement mixture that is poured or pumped through the hollow inner core of the helical structure 21*a*, when the auger 9' and the casing pipe are both going up. From this point on the excavated pile is finished off, with relative application of a reinforcement cage, when provided, which is widely known in the field.

In a first variant of the method, the helical drill bit 20 is brought outside of the cutting crown 18 (in advanced position) in an intermediate step between the initial step and that corresponding to the drilling of the maximum piped depth.

In a second variant of the method the helical drill bit 20 from the outset starts in advanced position with respect to the crown 18. In this case, the piped depth will be shorter, for a level substantially equal to the height of the helical drill bit 20. Such a variant is advantageous because the helical drill bit 20 never has to work inside the crown 18, a step in which it is required for it to break up the ground, and it can always work outside of it. In this way the pilot bit 28 can also be selected so as to take up a significant axial extension so as to act as a centering element to best contain the transversal thrusts that develop during the eccentric excavation carried out by the helical end section 20*i* of the helical drill bit 20.

Moreover, as a further variant, a pilot hole, directed vertically and with an equivalent diameter to that of the pilot bit 28, can be preliminarily made with directed drilling techniques and if required, when the ground is very compacted or when there are rocky layers, advantageously formed using water or air-operated down-the-hole hammers, head hammers or vibrating-rotating system.

Once the pilot hole has been obtained at the predetermined distance, the drilling of the helical drill bit 20 can begin by slotting the pilot bit 28 in the aforementioned pilot hole. In this case, when dealing with very compacted ground, the directed pilot hole (possibly filled with light filling materials like foams, sand, mixtures, . . . ) acts as a further guide for the helical drill bit 20 that will advance testing and guided in two different locations, the first at the base of the pilot bit 28 and the second at the interface between the proximal section 23 of the helical structure and the inner surface of the cutting crown 18.

The drilling will therefore proceed with the maximum guarantee of keeping the desired maximum diameter obtained thanks to the helical drill bit 20, which can advantageously be equal to the diameter that can be obtained through the cutting action of the crown 18.

A further variant provides not simultaneously extracting the casing pipe 10 and the auger 9' in the casting step, but leaving the casing pipe 10 in the drilling (perhaps keeping it in rotation), extracting just the auger 9' defining the overall helical structure. In this way, the helical drill bit 20 will be extracted passing through the cutting crown 18 and at that moment making the overall helical structure take up a deviated configuration.

Once the helical drill bit 20 has passed and the problems of joint have been avoided with a suitable proportioning of the diametral clearances and lengths, it is possible to complete the casting, proceeding with the possible insertion of reinforcement in the casing pipe 10 in the fresh concrete and then finishing with the extraction of the casing pipe 10.

According to a variant of the method described above, it is also possible to carry out piped drilling in two successive operating steps. In the first of these just the casing pipe 10 is driven to the maximum provided depth, after which the machine 1 releases it leaving it in the hole. In the second step, the same machine 1 or another one without distinction, can be set up with just the auger 9' equipped at its end with at least one lower helical end section 20*i* and alternatively with an intermediate section 20*s* or with a support portion 23 or even with both, until a length is reached such as to allow excavation below the casing pipe 10. The same auger 9' could be sufficiently long to reach the maximum unpiped depth required or it could be equipped with a tube 15 to extend its excavation lengths. Once excavated inside the raising pipe 10, the machine can continue feeding the excavation beyond the piped drilling, continuing at least to rotate or to push if necessary, until the required level is reached. Alternatively, the same machine could hook the pipe again to be able to move it axially with respect to the auger 9' or to put it in counter-rotation in order to reduce its frictions.

A further variant of this device is represented by a helical drill bit 20 equipped with a protruding portion that is significantly longer than the diametral bulk of the casing pipe 10. When the value of the eccentricity is substantial or the drill tooth 26 is mounted on the protruding part 25 and is sized so as to make a very protruding radial cut, then the excavation diameter of the bit 20 can be substantially greater than that excavated by the cutting crown 18. In this condition, it is possible to make excavations at the base of the pile (corresponding to the piped portion) with enlarged diameter, thus with a bulb capable of increasing the load-bearing capacity of the pile.

Figure 17:
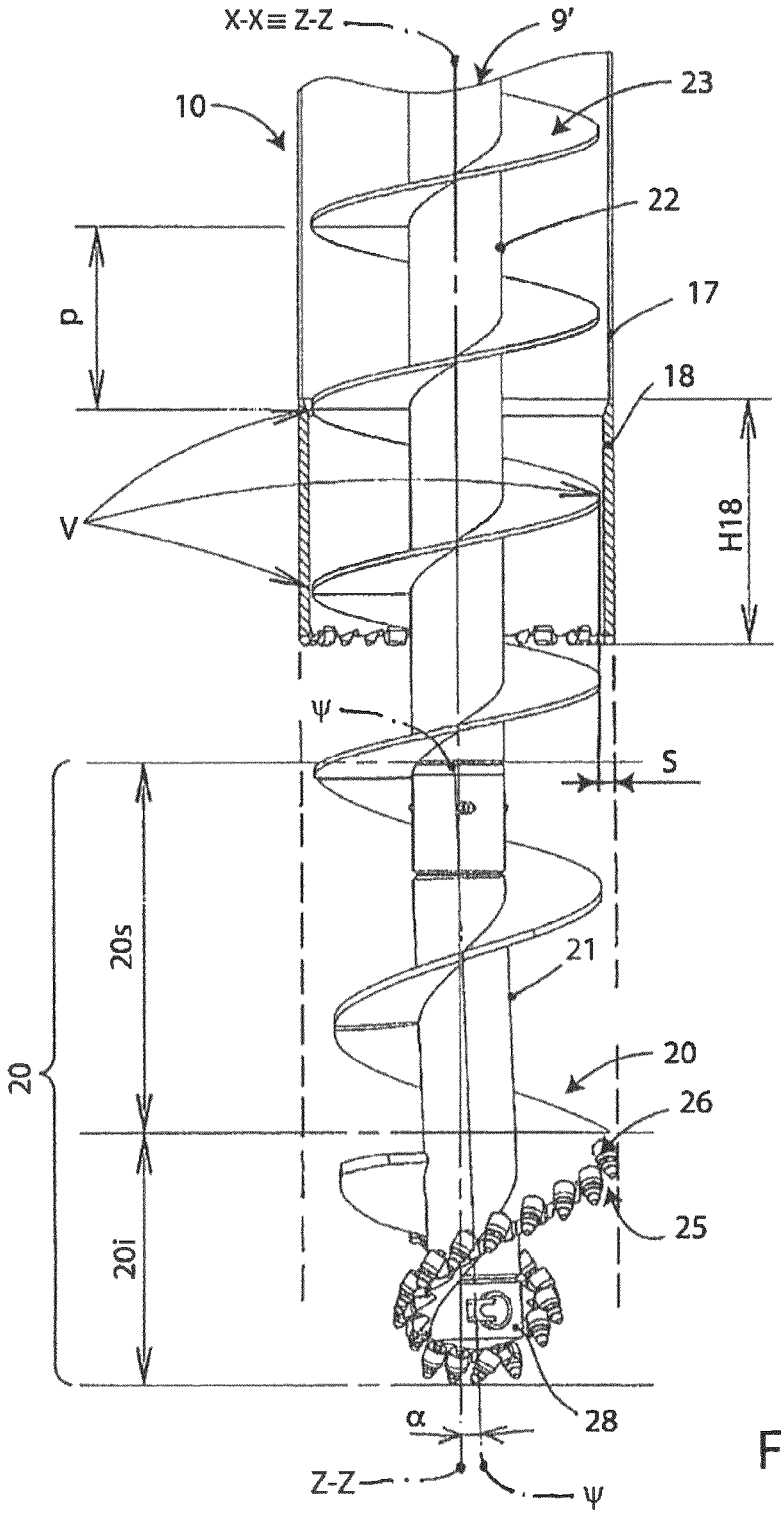
FIGS. 17 and 18 are partial side elevation views of an excavation assembly including an auger equipped with a further example embodiment of a helical drill bit according to the present invention, in combination with a casing pipe carried by the equipment visible in FIG. 5.
Figure 18:
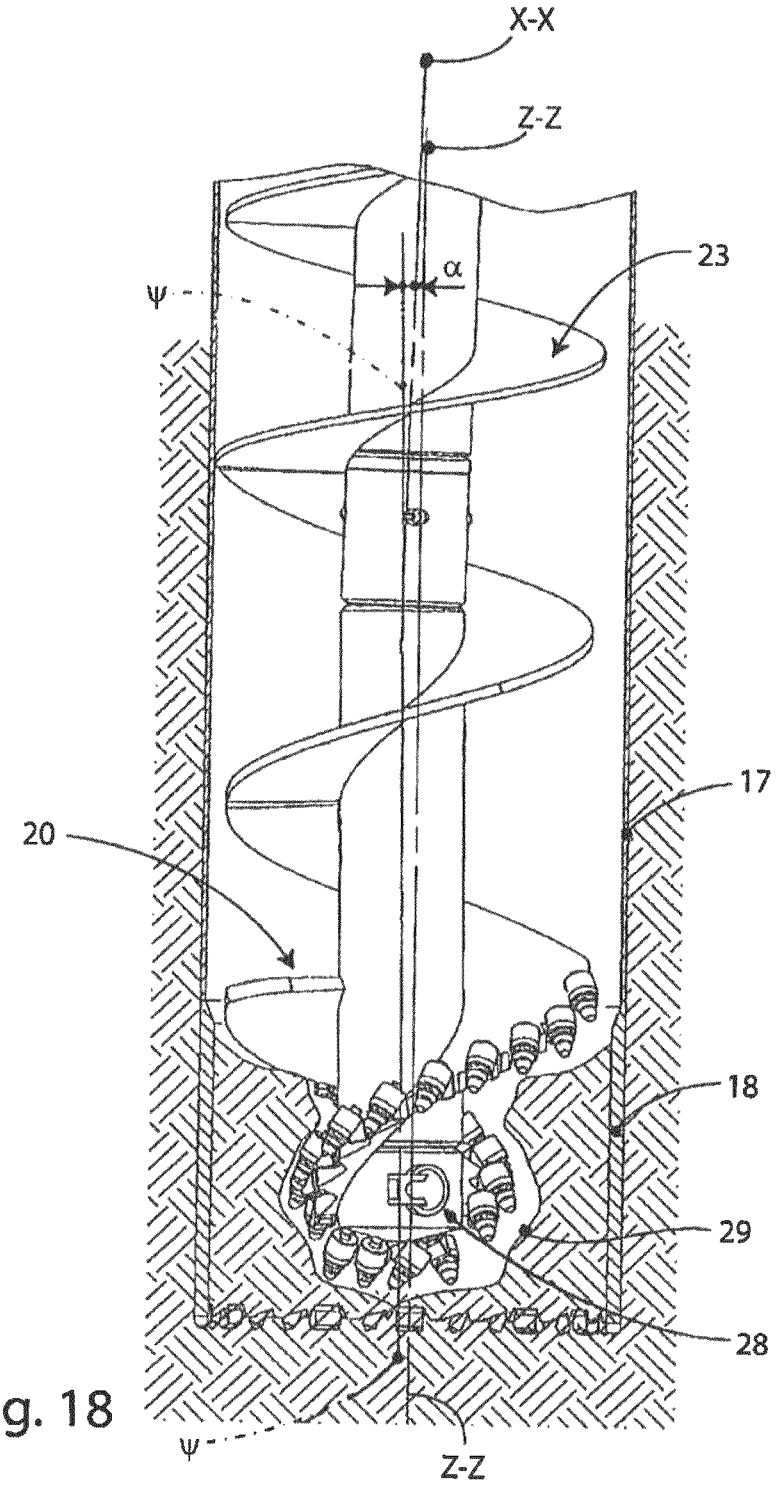

With reference to FIGS. 17 and 18, a further embodiment of a helical drill bit 20 according to the present invention is shown. Such a helical drill bit 20 is equipped with an extremity axis Ψ-Ψ that is also misaligned with respect to the longitudinal axis X-X. In other words, the extremity axis Ψ-Ψ is offset with respect to the longitudinal axis X-X.

Again with reference to the aforementioned further embodiment, the extremity axis Ψ-Ψ is inclined, in other words it is angularly offset, by an angle α with respect to the longitudinal axis X-X of the support portion 23 and thus of a main part of the auger 9'. The angle α thus defines an "angular eccentricity" (substantially equivalent to the so-called "transversal or radial eccentricity" indicated with "e" in the embodiment of the bit 20 illustrated in the previous figures) that the helical end section 20*i* takes up with respect to the rest of the helical structure defined by the auger 9'. Preferably but not necessarily, the extremity axis Ψ-Ψ is incident with the longitudinal axis X-X.

In a preferred manner, the angle α is less than 5°, in particular in the illustrated embodiment it is equal to about 2°. The inclination of mounting of the trunk 22 with respect to the axis of the trunk 21, ensures that the out the teeth of the helical drill bit can be projected radially, when the helical drill bit 20 is advancing with respect to the casing pipe 10, to excavate at a diameter that is advantageously equal to the cutting diameter of the excavation crown 18. In particular, it is preferable for the helical drill bit 20 to be pushed downwards at the moment when it is wished to begin the relative excavation at the unpiped depth, so that it is arranged eccentrically with respect to the axis Z-Z of the casing pipe 10. Just the rotation allows the helical drill bit 20 to cut the ground keeping the axis coinciding with the longitudinal axes X-X or Z-Z, whereas the bit itself will describe a cone with upper vertex positioned on the aforementioned axes. In order to recover possible displacements of the bit towards the centre, it will be possible to push on the auger 9' thus ensuring that it goes back into eccentric position. For this purpose, a pilot bit 28', like the one shown in FIG. 12, could further facilitate the eccentric excavation position of the bit 20.

When the helical drill bit 20 is confined inside the casing pipe 10 (FIG. 18), the auger 9' will be arranged in a deviated configuration so as to allow the lower helical end section 20*i*, with inclined axis Ψ-Ψ to be housed inside the excavation crown 18. The longitudinal axis X-X, like in the previous cases, will therefore be arranged in a deviated configuration, since on the top it is kept centred by the upper drive head 12*s*, whereas at the bottom, near to the helical drill bit 20, it will be moved by a similar extent as the value of the eccentricity. In other words, the cutting teeth 26 that are positioned on the protruding region 25 (which is defined in the section of auger that by virtue of the inclination of the extremity axis Ψ-Ψ gives it the greater distance from the longitudinal axis Z-Z, coinciding with the axis of the pile) are capable of cutting the over-excavation "s" beneath the casing pipe 10, thus being able to allow drilling of diameter advantageously equal to that of the cutting crown 18.

Of course, without affecting the principle of the invention, the embodiments and the details thereof can be widely varied with respect to what has been described and illustrated purely as a non-limiting example, without for this reason departing from the scope of protection of the invention as defined by the attached claims.

For example, as if is clear to a man skilled in the art, both of the embodiments of the bit 20 and the relative drilling method according to the present invention can also be used in an embodiment of equipment as shown in FIG. 1, especially in the version with sliding devices 6 connected between upper drive head 4*s* and auger 9.

Moreover, as is clear in light of the present description, a man skilled in the art can make a further variant of helical drill bit 20 the helical end section 20*i* of which has the respective extremity axis equipped with a transversal offset (or distance) and simultaneously with an angular offset (or inclination) with respect to the longitudinal axis X-X. In other words, in this case the extremity axis would assume both a so-called "transversal eccentricity" (or radial) indicated with "e" and an "angular eccentricity" indicated with "α", and it would therefore be oriented in space in a substantially skew manner with respect to the longitudinal axis X-X. Clearly, in this case:

- the transversal offset or eccentricity "e" would correspond to the minimum distance in space between the longitudinal axis X-X and the extremity axis; and
- the angular offset or eccentricity "α" would correspond to the angle defined by the projection of the aforementioned axes on a plane perpendicular to the direction of the transversal eccentricity "e" and passing through the longitudinal axis X-X.

LEGEND OF ALPHANUMERIC REFERENCES

1 machine or self-propelled machine
2 mast
3 trolley
4*i* lower drive head
4*s* upper drive head
5 guide member or openable annular element
6 sliding device or jack
7 hoisting winch or winch.
8 lower snub pulley
9 auger or drilling tool
9' auger or drilling tool
10 casing pipe
11*i* lower trolley
11*s* upper trolley
12*i* lower or "intubating" drive head
12*s* upper drive head
13 service winch
14 lifting device or winch
15 extension or "long tube" or tube
16 half-joint or coupling portion
17 jacket pipe
18 cutting crown or shoe
18*a* intermediate step
20 helical drill bit or auger bit
20*i* lower helical end section
20*s* intermediate section
21 excavation shaft or trunk
21*a* hollow inner core of the trunk 21
22 support trunk or shaft
23 support portion
24 arched recess
25 protruding portion
26 drill tooth
27 union
28 pilot bit or central bit
28' end of the pilot bit
29 excavation imprint
C circumference described by the central bit 28
e eccentricity
$D_e$ outer diameter
$D_{i1}$ inner diameter of the jacket pipe 17
$D_{i2}$ inner diameter of the cutting crown 18
H distance between helical drill bit 20 and cutting crown 18
p auger support portion pitch 23
rt reactions of the ground
rp reaction section of the bit
s over-excavation
s17 thickness of the jacket pipe 17
s18 thickness of the cutting crown 18
V interface or contact points
W lifting height of the casing pipe 10
X-X longitudinal axis of the auger 9'
Y-Y axis of extremity or of eccentricity
Z-Z longitudinal axis of the casing pipe 10
$l_{min}$ smaller dimension of the section 20*s*
$l_{max}$ larger dimension of the section 20*s*
Ψ-Ψ axis of the helical drill bit 20 or extremity axis
α angle of inclination of the axis Ψ-Ψ
$\Phi_s$ diameter of the support portion 23
$\Phi_i$ diameter of the helical end section 20*i*

The invention claimed is:

1. A helical drill bit for an auger of a ground excavation assembly, in particular for building excavated piles;

said excavation assembly including said auger and an external casing pipe defining an internal axial cavity such as to allow the auger to pass through it, wherein said auger and casing pipe are capable of sliding axially with respect to one another, said auger being connected to an upper drive head and said casing being connected to a lower drive head thereby allowing said auger and said casing to rotate independent from each other;

said auger forming at its periphery a helical or Archimedean screw-type structure and having a support portion defining a proximal section of a helical structure, the extension of which is substantially centered around a longitudinal axis (X-X) so that the spirals of the auger wrap around said longitudinal axis (X-X);

said helical drill bit defining at least one helical lower end section of said helical structure, being associated or associable with said support portion, and being arranged to rotate about said longitudinal axis (X-X) together with said support portion so as to drill a hole into a ground;

said lower helical end section extending substantially centered around an axis of eccentricity (Y-Y; Ψ-Ψ) offset from said longitudinal axis (X-X) so that the spirals of the drill bit defined by said lower helical end section wrapped around said axis of eccentricity (Y-Y; Ψ-Ψ) are not aligned to the spirals of the drill bit defined by said support section wrapped around said longitudinal axis (X-X)

wherein said helical drill bit further defines an intermediate section of said helical structure of the auger; said intermediate section being substantially centered around the longitudinal axis (X-X) and being located between the proximal section of the auger and the lower end section of the helical drill bit wherein the radial size of the spirals of the drill bit defined by said intermediate section, when observed in a plan view relative to the longitudinal axis (X-X), is smaller than the radial size of the helical structure defined by said auger, the transversal shape of said intermediate section remaining within the transversal shape defined by said proximal section and by said lower end section.

2. The helical drill bit according to claim 1, wherein said lower helical end section has a helical extension that is tapered with respect to said axis of eccentricity (Y-Y; Ψ-Ψ) so that the spirals of the drill bit defined by said lower helical end section wrap with progressively decreasing radial size with respect to said axis of eccentricity (Y-Y; Ψ-Ψ).

3. The helical drill bit according to claim 1, wherein said axis of eccentricity (Y-Y; Ψ-Ψ) has at least one of the following features:

a transversal offset, or radial distance, (e) relative to said longitudinal axis (X-X); and an angular offset, or inclination, (α) relative to said longitudinal axis (X-X).

4. The helical drill bit according to claim 1, wherein said helical lower end section carries at least one drill tooth placed in at least one portion of the lower end section that is radially protruding with respect to the radial size of the spirals of the auger.

5. The helical drill bit according to claim 1, wherein the helical structure defined by said helical lower end section is substantially of a double-start screw type.

6. The helical drill bit according to claim 1, wherein said radial size of the spirals defined by said intermediate section is:

variable, forming a quasi-circular shape of the spirals of the intermediate section, with a center lying on the longitudinal axis (X-X) and a diameter equal to that of the helical end section, but with a periphery having an arched recess.

7. An auger of a ground excavation assembly, in particular for building excavated piles;

said auger being equipped with a helical drill bit according to claim 1;

said auger being associated or associable with an extension element with elongated substantially cylindrical shape, with outer diameter comparable to that of the trunk of the auger, adapted to be mounted on top of said auger and around which an upper drive head is axially slidable for clamping said extension element at least at an upper locking point and at a lower locking point in order to increase an excavation depth of said auger by an extent equal to the travel of said upper drive head from said lower locking point to said upper locking point.

8. A method for drilling the ground surface, in particular for building excavated piles, said method comprising the following operative steps:

a) providing an excavation assembly according to claim 7;

b) bringing the auger into an unpiped drilling operating configuration, wherein said helical drill bit is in an axially advanced position, wherein at least said helical lower end section is completely underneath said casing pipe and wherein the inner walls of said casing pipe guide at least one portion of said helical structure, the longitudinal axis (X-X) of the auger substantially coinciding with the longitudinal axis (Z-Z) of the casing pipe and excavating by advancing the helical drill bit and the casing pipe at the same time into the ground; and c) excavating the ground by advancing and by operating in rotation relative to the longitudinal axis (X-X) said helical drill bit, thereby making an excavation having a diameter defined by said helical lower end section and having a radial extension with respect to the longitudinal axis X-X substantially equal to radial extension of the excavation previously made by said casing pipe in step b).

9. The method according to claim 8, wherein step b) is preceded by the following operating steps:

a1) bringing said auger into a piped drilling configuration, wherein said helical drill bit is in an axially retracted position in which said helical end section is contained in said casing pipe; and a2) excavating by advancing the helical drill bit and the casing pipe at the same time into the ground operating said auger and said casing pipe in rotation relative to their respective longitudinal axes (X-X, Z-Z) so as to remove the ground excavated by the casing pipe and transport at least a part of said excavated ground out of the excavation by means of said helical structure.

10. The method according to claim 9, wherein at step a2) a pilot bit carried by said helical drill bit describes a circular trajectory (C) having a radius substantially equal to the value of the transversal offset, or radial distance, (e) of said helical end section with respect to said longitudinal axis (X-X) of said auger, tending to deviate said longitudinal axis (X-X) of the auger with respect to the longitudinal axis (Z-Z) of the casing pipe.

11. The method according to claim 9, wherein the operating step a2) ends when:

the casing pipe has reached a level equal to a maximum piped depth, or the casing pipe has reached an intermediate level between the ground surface and said maximum piped depth.

12. The method according to claim 9, wherein the following intermediate operating step is carried out between step a2) and step b):

a3) lifting the casing pipe from the position of the piped drilling operating configuration in order to bring it to a level equal to at least the height of said helical drill bit.

13. The method according to claim 8, wherein during step c) the casing pipe is operated at least in rotation together with the auger until the casing pipe reaches a level substantially equal to a piped depth.

14. The method according to claim 13, wherein after the casing pipe has reached a level substantially equal to said piped depth during step c), said auger is pushed in order to center said pilot bit carried by said helical drill bit against an excavation imprint, aligning said auger with the longitudinal axis (Z-Z) of the casing pipe.

15. The method according to claim 8, wherein during step c) said pilot bit carried by the helical drill bit crosses a pilot hole made in the ground in a direction substantially coinciding with the longitudinal axis (Z-Z) of the casing pipe, wherein said pilot hole acts as a guide for the helical drill bit and keeps the helical end section aligned as desired during drilling.

* * * * *